US007907044B2

(12) United States Patent
Tada et al.

(10) Patent No.: US 7,907,044 B2
(45) Date of Patent: Mar. 15, 2011

(54) LAMINATE DEVICE AND MODULE COMPRISING SAME

(75) Inventors: Tomoyuki Tada, Mishima-gun (JP); Toru Umeno, Tottori (JP); Yasuharu Miyoshi, Mishima-gun (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 12/162,724

(22) PCT Filed: Jan. 31, 2007

(86) PCT No.: PCT/JP2007/051648

§ 371 (c)(1),
(2), (4) Date: Jul. 30, 2008

(87) PCT Pub. No.: WO2007/088914

PCT Pub. Date: Aug. 9, 2007

(65) Prior Publication Data

US 2009/0051476 A1 Feb. 26, 2009

(30) Foreign Application Priority Data

Jan. 31, 2006 (JP) ..... 2006-023775
May 31, 2006 (JP) ..... 2006-152542

(51) Int. Cl.
*H01F 5/00* (2006.01)

(52) U.S. Cl. ..... 336/200; 336/223; 336/232

(58) Field of Classification Search ..... None
See application file for complete search history.

(56) References Cited

U.S. PATENT DOCUMENTS

| | | | | |
|---|---|---|---|---|
| 5,206,620 | A * | 4/1993 | Watanabe et al. | 336/84 M |
| 5,469,399 | A | 11/1995 | Sato et al. | |
| 5,572,478 | A | 11/1996 | Sato et al. | |
| 6,459,351 | B1 * | 10/2002 | Maki et al. | 336/200 |
| 6,504,466 | B1 * | 1/2003 | Katsurada | 336/200 |
| 6,515,568 | B1 | 2/2003 | Maki et al. | |
| 7,380,328 | B2 * | 6/2008 | Ahn et al. | 29/602.1 |
| 2002/0140539 | A1 * | 10/2002 | Takashima et al. | 336/200 |
| 2003/0068998 | A1 | 4/2003 | Yamakawa et al. | |
| 2004/0032706 | A1 * | 2/2004 | Kemmochi et al. | 361/306.3 |
| 2004/0207488 | A1 | 10/2004 | Kono et al. | |
| 2006/0152325 | A1 | 7/2006 | Nakao et al. | |
| 2007/0182519 | A1 * | 8/2007 | Tsuzuki et al. | 336/200 |
| 2007/0230221 | A1 * | 10/2007 | Lim et al. | 363/16 |

FOREIGN PATENT DOCUMENTS

| | | | |
|---|---|---|---|
| CN | 1282969 | A | 2/2001 |
| JP | 02-165607 | A | 6/1990 |
| JP | 06-224043 | A | 8/1994 |
| JP | 07-021791 | A | 1/1995 |
| JP | 2001-044037 | A | 2/2001 |
| JP | 2003-158467 | A | 5/2003 |
| JP | 2003-347124 | A | 12/2003 |
| JP | 2004-343084 | A | 12/2004 |
| JP | 2005-045108 | A | 2/2005 |
| JP | 2005045108 | | 2/2005 |
| JP | 2005-053759 | A | 3/2005 |

(Continued)

*Primary Examiner* — Anh T Mai
(74) *Attorney, Agent, or Firm* — Sughrue Mion, PLLC

(57) ABSTRACT

The laminate device of the present invention comprises magnetic layers and coil patterns alternately laminated, the coil patterns being connected in a lamination direction to form a coil, and pluralities of magnetic gap layers being disposed in regions in contact with the coil patterns.

9 Claims, 26 Drawing Sheets

FOREIGN PATENT DOCUMENTS

| | | | |
|---|---|---|---|
| JP | 2005-150168 | A | 6/2005 |
| JP | 2005-268455 | A | 9/2005 |
| JP | 2006-216916 | A | 8/2006 |
| WO | 2005032226 | A1 | 4/2005 |

* cited by examiner

: Direction of Current

: Direction of Current

: Direction of Current

LAMINATE DEVICE AND MODULE COMPRISING SAME

CROSS REFERENCE TO RELATED APPLICATION

This application is a National Stage of International Application No. PCT/JP2007/051648 filed Jan. 31, 2007, claiming priority based on Japanese Patent Application Nos. 2006-023775, filed Jan. 31, 2006 and 2006-152542, filed May 31, 2006, the contents of all of which are incorporated herein by reference in their entirety.

FIELD OF THE INVENTION

The present invention relates to a laminate device having a magnetic circuit constituted by laminating coil patterns and magnetic material layers, particularly to a laminated inductor having non-magnetic or low-permeability magnetic gap layers in a magnetic circuit path, and a module (composite part) having semiconductor devices and other reactance elements mounted on a ferrite substrate having electrodes, etc.

BACKGROUND OF THE INVENTION

Various portable electronic equipments (cell phones, portable information terminals PDA, note-type personal computers, portable audio/video players, digital cameras, digital video cameras, etc.) usually use batteries as power supplies, comprising DC-DC converters for converting power supply voltage to operation voltage. The DC-DC converter is generally constituted by integrated semiconductor circuits (active parts) including switching devices and control circuits, inductors (passive parts), etc. disposed as; discrete parts on a printed circuit board.

For the miniaturization of electronic equipments, the DC-DC converter has an increasingly higher switching frequency, using more than 1 MHz at present. Because semiconductor devices such as CPU are getting higher in speed, function and current and lower in operating voltage, low-voltage, high-current DC-DC converters are needed.

Passive parts used in power supply circuits for DC-DC converters, etc. are required to be smaller in size and height, and integrated with active parts. The inductor, one of passive parts, has conventionally been composed of a wire wound around a magnetic core, and its miniaturization is limited. Because lower inductance is needed in order that laminate devices are operable at higher frequencies, monolithic laminate devices having a closed magnetic path structure have become used.

The laminated inductor, an example of laminate devices, is produced by integrally laminating magnetic material (ferrite) sheets printed with coil patterns, and sintering them. The laminated inductor has excellent reliability with little magnetic flux leakage. However, because it has an integral structure, magnetic saturation partially occurs in a magnetic material in the laminated inductor by a DC magnetic field generated when a magnetization current is applied to the coil pattern, resulting in drastic decrease in inductance. Such laminated inductors have poor DC-superimposed characteristics.

To solve this problem, JP 56-155516 A and JP 2004-311944 A disclose a laminated inductor 50 having an open magnetic path structure comprising a magnetic gap layer between magnetic layers, as shown in FIG. 47. This laminated inductor 50 is formed by laminating pluralities of magnetic (ferrite) layers 41 with coil pattern layers 43, the magnetic gap layer 44 made of a non-magnetic material being inserted into a magnetic path. In the figure, a magnetic flux is schematically shown by arrows. At small magnetization current, a magnetic flux $\phi a$ flowing around each coil pattern 43, and a magnetic flux $\phi b$ flowing around pluralities of coils patterns 43 are formed in each of regions separated by the magnetic gap layer 44. Most magnetic fluxes do not pass through the magnetic gap layer 44, but a magnetic flux path is formed in each region separated by the magnetic gap layer 44, as if two inductors were series-connected in one device. At large magnetization current, on the other hand, material portions between the coil patterns 43 are magnetically saturated, so that most magnetic fluxes pass through the magnetic gap layer 44 like the magnetic flux $\phi c$, and flow around pluralities of coils patterns, resulting in a demagnetizing field that lowers inductance than in the case of small magnetization current. However, the laminated inductor becomes resistant to magnetic saturation. Thus, the conventional laminated inductor has DC-superimposed characteristics improved by the magnetic gap layer, but its inductance largely varies by slight increase in magnetization current. Although the DC-superimposed characteristics are improved as compared with when the magnetic gap layer 44 is not formed, further improvement is needed so that the laminated inductor is operable at large magnetization current.

JP 2004-311944 A discloses a laminated inductor 50 comprising a magnetic gap layer 44 embedded at center between coil patterns, and a non-magnetic body 47 embedded around the coil patterns, as shown in FIG. 48. Because most magnetic fluxes pass through the magnetic gap layer 44, this laminated inductor 50 has stable inductance in a range from small magnetization current to large magnetization current, but exhibits insufficient performance at large magnetization current. In addition, it is difficult to produce because of a complicated structure.

OBJECT OF THE INVENTION

Accordingly, an object of the present invention is to provide an easily producible laminate device giving stable inductance in a range from small magnetization current to large magnetization current, with excellent DC-superimposed characteristics, and a module comprising such laminate device.

DISCLOSURE OF THE INVENTION

As a result of intense research in view of the above object, the inventors have found that in a laminate device containing coil patterns, the formation of pluralities of magnetic gap layers in regions each in contact with the coil pattern makes magnetic saturation less likely in a magnetic material portion even with large magnetization current, resulting in decrease in eddy current loss. The present invention has been completed based on such finding.

Namely, the laminate device of the present invention comprises magnetic layers and coil patterns alternately laminated, the coil patterns being connected in a lamination direction to form a coil, and pluralities of magnetic gap layers being disposed in regions in contact with the coil patterns.

The magnetic gap layers are preferably formed in contact with at least two coil patterns adjacent in a lamination direction. A magnetic flux generated from one coil pattern passes through a magnetic gap layer in contact therewith, but less through magnetic gap layers in contact with the other coil patterns, so that it flows around that one coil pattern. Because magnetic fluxes generated from two adjacent coil patterns are canceling each other in a magnetic material portion between the coil patterns, magnetic saturation is unlikely even with large magnetization current.

The number of the coil patterns having the magnetic gap layers is preferably 60% or more of the number of turns of the coil. The coil is preferably formed by connecting the coil patterns of 0.75 turns or more to 2 turns or more. At least some of the coil pattern preferably has more than one turn. The coil pattern is preferably made of a low-melting-point metal such as Ag, Cu, etc., or its alloy. When each coil pattern has less than 0.75 turns, too many coil-pattern-caring layers are laminated. Particularly when each coil pattern has less than 0.5 turns, there is too large an interval between the coil patterns adjacent in a lamination direction. Some of the coil patterns acting as leads, etc. may have less than 0.75 turns.

With at least some of the coil patterns having more than one turn, the number of coil-pattern-carrying layers can be reduced. A coil pattern having more than one turn inevitably increases an area in which the coil pattern is formed, with a reduced cross section area of a magnetic path. However, the formation of a magnetic gap layer between adjacent coil patterns on a magnetic substrate layer provides inductance not smaller than that obtained when coil patterns having one turn or less are used. Such structure, however, makes magnetic saturation likely because of the reduction of a cross section area of a magnetic path, and increases floating capacitance between coil patterns opposing on the same magnetic substrate layer, thereby reducing a resonance frequency and lowering the quality coefficient Q of the coil. Accordingly, in the case of a 3216-size laminate device, for instance, a coil pattern on each layer preferably has 3 turns or less.

The magnetic gap layer is preferably made of a non-magnetic material or a low-permeability material having a specific permeability of 1-5. A ratio $t_2/t_1$ of the thickness $t_2$ of the magnetic gap layer to the thickness $t_1$ of the coil pattern is preferably 1 or less, more preferably 0.2-1.

With at least some of the coil patterns having such structure, the laminate device has improved DC-superimposed characteristics. Magnetic gap layers in contact with all coil patterns provide stable inductance in a range from small magnetization current to large magnetization current, and excellent DC-superimposed characteristics, which keeps the inductance from lowering.

The magnetic gap layer and the coil pattern may or may not be overlapping on the magnetic substrate layer. In any case, the magnetic gap layers are in contact with the coil patterns, and a magnetic flux generated from the coil pattern passes, through a magnetic gap layer formed on the same magnetic substrate layer, and flows along a loop through magnetic materials (magnetic substrate layers and magnetic-material-filled layers) around each coil pattern.

The magnetic gap layer preferably has at least one magnetic region. The magnetic region in the magnetic gap layer has such area and magnetic properties that it is more subjected to magnetic saturation with small magnetization current than in the magnetic layer between coil patterns adjacent in a lamination direction. With such structure, the inductance is high at small magnetization current, and lowers as the magnetization current becomes larger, but the magnetic region and the magnetic gap layer function as an integral magnetic gap, providing stable inductance.

The laminate device is subjected to stress due to the difference in sintering shrinkage and thermal expansion among the magnetic layers, the coil patterns and the magnetic gap layers, the warp of a laminate-device-mounting circuit board, etc. Because the magnetic properties of the magnetic layers are deteriorated by stress and strain, it is preferable to use Li ferrite suffering little change of permeability by stress (having excellent stress resistance). Thus obtained is a laminate device suffering little change of inductance by stress.

An example of the modules of the present invention is obtained by mounting the above laminate device on a dielectric substrate containing capacitors, together with a semiconductor part including a switching device. Another example of the modules of the present invention is obtained by mounting the above laminate device on a resin substrate, together with a semiconductor part including a switching device. A further example of the modules of the present invention is obtained by mounting a semiconductor part including a switching device on the above laminate device.

BRIEF DESCRIPTION OF THE DRAWINGS

FIG. 5(*b*) is a cross-sectional view showing a magnetic layer used in an example of the first laminate devices of the present invention.

FIG. 6(*b*) is a cross-sectional view showing another magnetic layer used in an example of the first laminate devices of the present invention.

FIG. 10(*b*) is a cross-sectional view showing another magnetic layer used in the second laminate device of the present invention.

FIG. 12(*b*) is a cross-sectional view showing another magnetic layer used in the third laminate device of the present invention.

FIG. 14(*b*) is a cross-sectional view showing another magnetic layer used in the fourth laminate device of the present invention.

FIG. 21(*b*) is a cross-sectional view showing another magnetic layer used in the fifth laminate device of the present invention.

FIG. 24(*b*) is a cross-sectional view showing another magnetic layer used in the sixth laminate device of the present invention.

DESCRIPTION OF THE PREFERRED EMBODIMENTS

The laminate devices of the present invention and their modules will be explained in detail below.

[1] First Laminate Device

Figure 1:
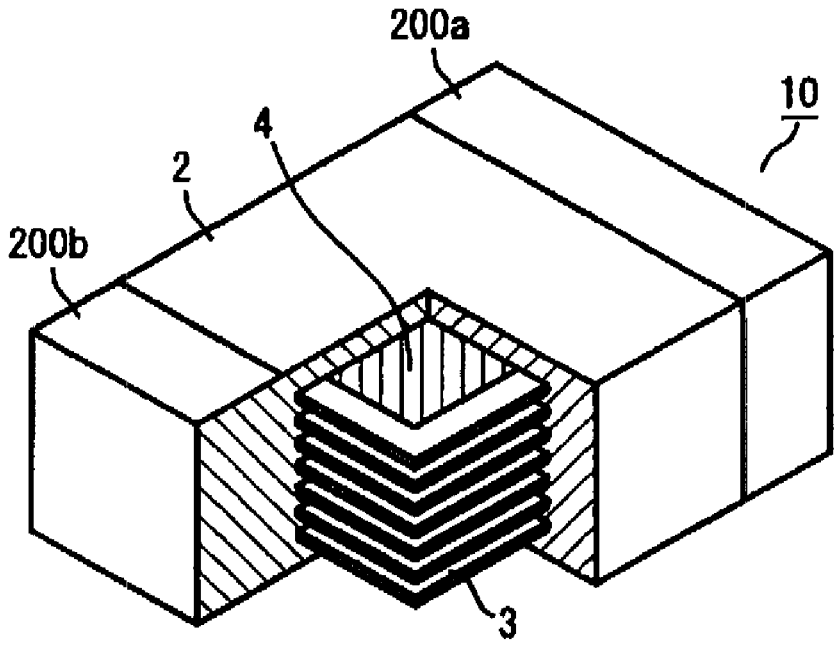
FIG. 1 is a perspective view showing the appearance of an example of the first laminate devices of the present invention.
Figure 2:
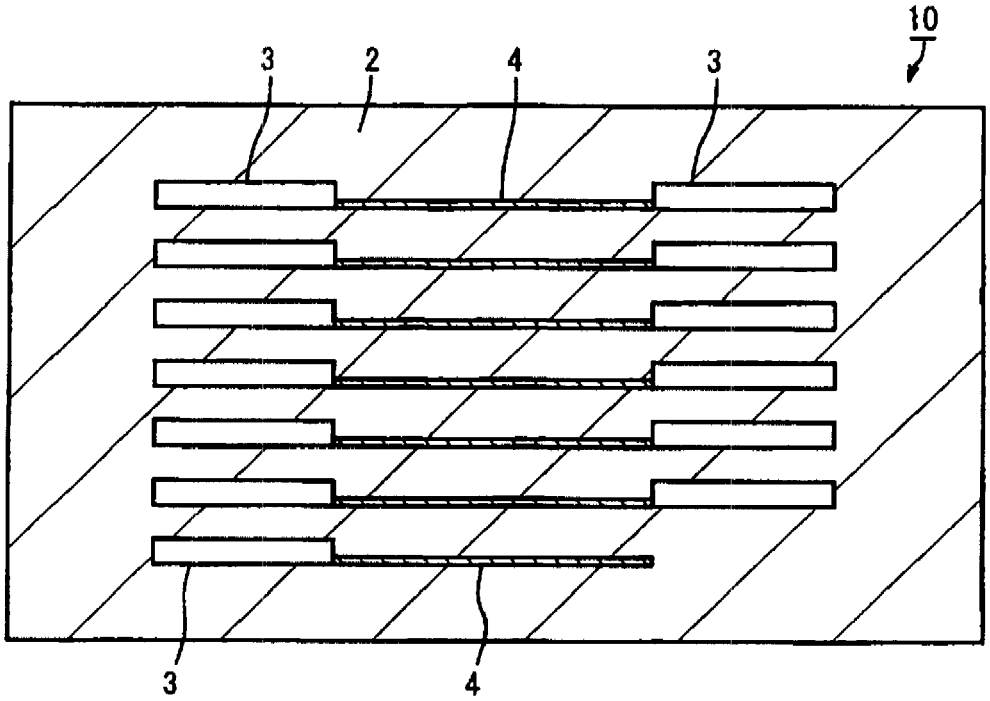
FIG. 2 is a cross-sectional view showing an example of the first laminate devices of the present invention.
Figure 3:
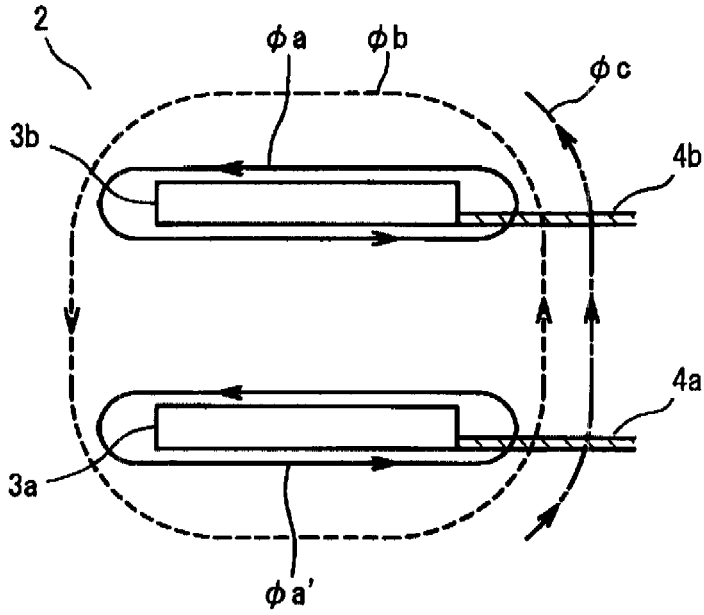
FIG. 3 is a schematic view showing a magnetic flux flow in an example of the first laminate devices of the present invention.
Figure 4:
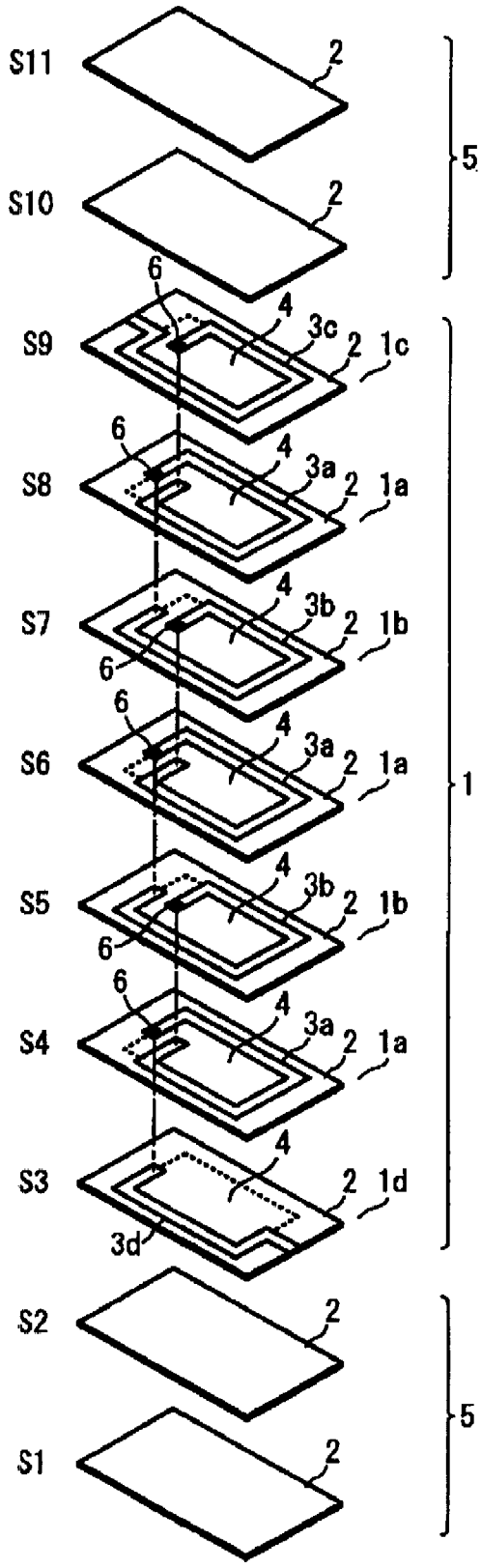
FIG. 4 is an exploded perspective view showing an example of the first laminate devices of the present invention.

FIG. 1 shows the appearance of a laminated inductor 10 and its internal structure as an example of the first laminate devices of the present invention, FIG. 2 shows the cross section of the laminated inductor 10 of FIG. 1, FIG. 3 shows a magnetic field distribution in the laminated inductor 10 of FIG. 1, and FIG. 4 shows layers constituting the laminated inductor 10 of FIG. 1.

(1) Structure of Laminate Device

The laminated inductor 10 comprises 11 layers (S1-S11), which has a coil part 1 formed by 7 coil-pattern-carrying layers 1*a*-1*d* each constituted by a magnetic substrate layer 2 provided with a coil pattern 3, and magnetic material parts 5 on both upper and lower sides of the coil part 1 each constituted by two magnetic substrate layers 2 free from a coil pattern. In the coil part 1, coil patterns 3 (3*a*-3*d*) each having 0.5 to 1 turn are connected via through-holes 6 to constitute a coil of 6.5 turns. Both ends of the coil extend to opposing side surfaces of the laminate device, and connected to external electrodes 200*a*, 200*b* obtained by baking a conductor paste of Ag, etc. As shown in FIG. 2, a magnetic gap layer 4 is formed in a region in contact with the inside of each coil pattern 3. The laminated inductor 10 is preferably formed by an LTCC (low-temperature co-fired ceramics) method.

Each coil-pattern-carrying layer 1*a*-1*d* is formed for instance, by forming a soft ferrite paste into a green sheet for a magnetic substrate layer 2 by a doctor blade method, a calendering method, etc., printing or coating the green sheet with a conductive paste of Ag, Cu or their alloys in a predetermined coil pattern 3*a*-3*d*, printing or coating a predetermined region of the green sheet with a non-magnetic paste for forming a magnetic gap layer 4, and printing or coating a coil-pattern-free region of the green sheet with a magnetic paste for covering the magnetic gap layer 4 to substantially the same height as an upper surface of the coil pattern, thereby forming a magnetic-material-filled layer 2*a*-2*d*. The magnetic-material-filled layers 2*a*-2*d* may have different shapes depending on the shapes of the coil patterns 3*a*-3*d* on the magnetic substrate layer 2. Each magnetic substrate layer 2 constituting the magnetic material part 5 is constituted by the same green sheets as described above. After plural (7) coil-pattern-carrying layers 1*a*-1*d* are laminated with the coil patterns 3*a*-3*d* connected to via through-holes 6 to form a coil, one or more (2) magnetic substrate layers 2 are preferably laminated on both sides thereof as shown in FIG. 4, and sintered at a temperature of 1100° C. or lower. Conductive materials for forming the external electrodes 200*a*, 200*b* are not particularly restrictive, but may be metals such as Ag, Pt, Pd, Au, Cu, Ni, etc., or their alloys.

Figure 5A:
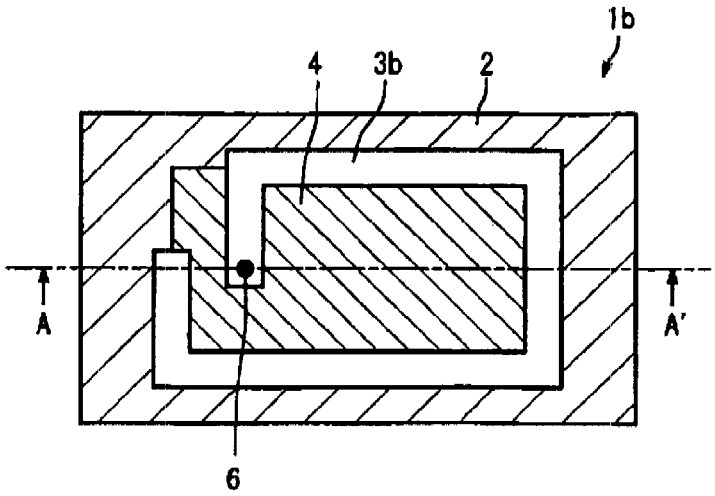
FIG. 5(*a*) is a plan view showing a magnetic layer used in an example of the first laminate devices of the present invention.
Figure 5B:
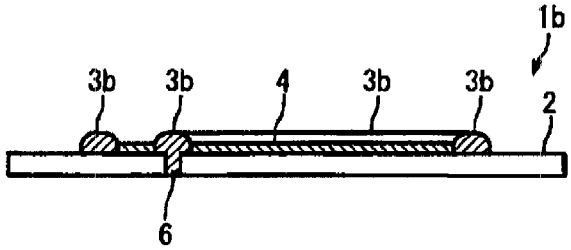

Because the shapes of the coil-pattern-carrying layers 1*a*-1*d* shown in FIG. 4 are different only in the coil patterns 3*a*-3*d* and the magnetic-material-filled layers 2*a*-2*d*, for instance, the coil-pattern-carrying layer 1*b* will be explained in detail referring to FIGS. 5(*a*) and 5(*b*). This explanation is applicable to other coil-pattern-carrying layers as it is. The coil-pattern-carrying layer 1*b* is obtained, for instance, by blending Li—Mn—Zn ferrite powder, a polyvinyl butyral-based organic binder, and a solvent such as ethanol, toluene, xylene, etc. in a ball mill, adjusting the viscosity of the resultant slurry, applying the slurry to a carrier film such as a polyester film, etc. by a doctor blade method, etc., drying it, providing the resultant green sheet (dry thickness: 15-60 μm) with through-holes for connection, printing the green sheet with a conductive paste to form a coil pattern 3*b* having a thickness of 10-30 μm and to fill the through-holes 6 with the conductive paste, printing or coating the green sheet with a non-magnetic paste 4 such as a zirconia paste such that the non-magnetic paste 4 covers an entire surface inside the coil pattern 3*b* to form a magnetic gap layer 4. The thickness of the magnetic gap layer 4 is preferably 3 μm or more, and equal to or less than that of the coil pattern 3*b*.

The magnetic gap layer 4 is formed by a magnetic gap layer paste such that it covers an entire region inside the coil pattern 3*b* in contact with the edge of the coil pattern 3*b*. Alternatively, a magnetic gap layer 4 having an opening may be first printed, and the coil pattern 3*b* may be printed in the opening. In this case, the coil pattern 3*b* covers an edge portion of the magnetic gap layer 4. In any case, an edge portion of each coil pattern 3 substantially overlaps an edge portion of the magnetic gap layer 4 after sintering. The overlapping of such magnetic gap layers 4 in a lamination direction reduces a magnetic flux of each coil pattern 3 crossing the other coil patterns.

The magnetic gap layer 4 is preferably thin and made of a non-magnetic material or a low-permeability material having a specific permeability of 1-5. Although the magnetic gap layer 4 made of a low-permeability material is inevitably thicker than that made of a non-magnetic material, it has suppressed variations of inductance by printing precision.

When the low-permeability material has a specific permeability more than 5, it has a low function as the magnetic gap layer 4. The low-permeability material having a specific permeability of 1-5 can be obtained by mixing non-magnetic oxide (zirconia, etc.) powder with magnetic powder. Also usable is Zn ferrite having a Curie temperature (for instance, −40° C. or lower) sufficiently lower than the use temperature of the laminate device. The Zn ferrite suffers sintering shrinkage close to that of the magnetic substrate layer 2.

Non-magnetic materials and low-permeability materials used for the magnetic gap layer 4 are $ZrO_2$, glass such as $B_2O_3$—$SiO_2$ glass and $Al_2O_3$—$SiO_2$ glass, Zn ferrite, $Li_2O$—$Al_2O_3$-$4SiO_2$, $Li_2O$—$Al_2O_3$-$2SiO_2$, $ZrSiO_4$, $3Al_2O_3$-$2SiO_2$, $CaZrO_3$, $SiO_2$, $TiO_2$, $WO_3$, $Ta_2O_5$, $Nb_2O_5$, etc. Pastes for the magnetic gap layer 4 are prepared, for instance, by blending zirconia ($ZrO_2$) powder, an organic binder such as ethylcellulose, and a solvent by three rolls, a homogenizer, a sand mill, etc. Using zirconia that is not made dense at a sintering temperature of the laminate device, the difference in a thermal expansion coefficient alleviates a compression stress that the magnetic substrate layer 2 receives from the coil pattern 3, thereby preventing the magnetic substrate layer 2 from being cracked. When the magnetic gap layer 4 exposed outside should be made dense, it is preferable to add an oxide of Zn, Cu, Bi, etc. (for instance, $Bi_2O_3$) as a low-temperature-sintering-accelerating material.

Figure 6A:
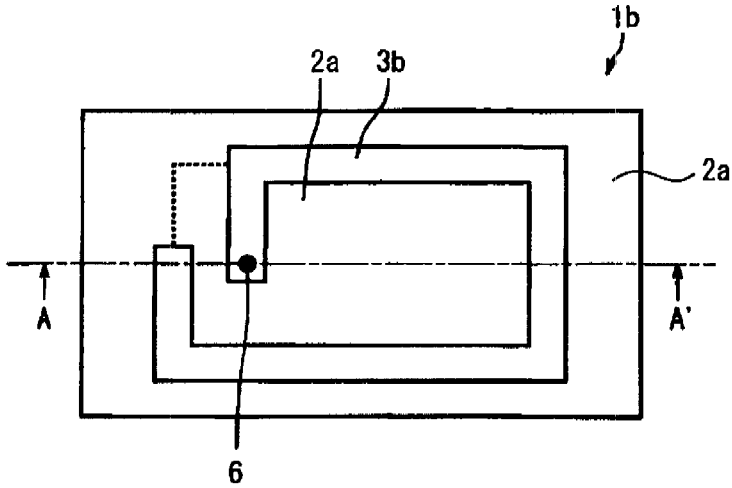
FIG. 6(*a*) is a plan view showing another magnetic layer used in an example of the first laminate devices of the present invention.
Figure 6B:
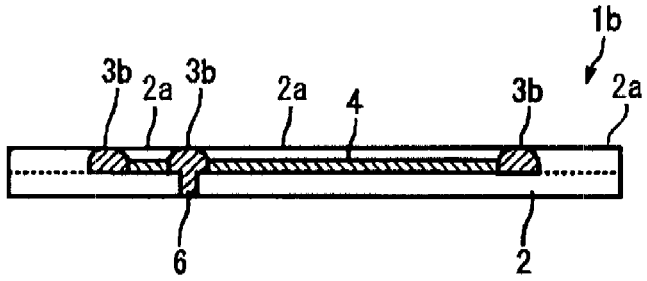

FIGS. 6(*a*) and 6(*b*) show a coil-pattern-carrying layer 1*b* having a magnetic-material-filled layer 2*a*, which is obtained by printing or coating a magnetic paste in a region except for the coil pattern 3*b* such that it is substantially on the same level as an upper surface of the coil pattern 3*b*. The magnetic paste preferably contains ferrite powder having the same main component composition as that of the green sheet. However, the ferrite powder may be different in the diameters of crystal particles, the types and amounts of sub-components, etc. The magnetic paste is produced by blending the magnetic powder with a binder such as ethylcellulose, and a solvent. For instance, even when the coil pattern is as thick as 15 μm or more, the magnetic-material-filled layer 2*a* can make the pressure-bonded laminate free from steps, thereby preventing delamination after pressure-bonding.

A magnetic material for the magnetic substrate layer 2 and the magnetic-material-filled layer 2*a* is preferably Li ferrite having a main component composition represented by the formula of $x(Li_{0.5}Fe_{0.5})O$-$yZnO$-$zFe_2O_3$, wherein x, y and z meet $0.05 \leqq x \leqq 0.55$, $0.05 \leqq y \leqq 0.40$, $0.40 \leqq z \leqq 0.55$, and $x+y+z=1$, and further containing 2-30% by mass of $Bi_2O_3$. This Li ferrite is sinterable at 800-1000° C., and has low loss and high specific resistance. It also has a small squareness ratio and excellent stress characteristics. The partial substitution of ZnO with CuO enables low-temperature sintering, and the partial substitution of $Fe_2O_3$ with $Mn_2O_3$ improves specific resistance.

In addition to the above Li ferrite, soft ferrite such as Ni ferrite, Mg ferrite, etc. may be used. The magnetic substrate layer 2 and the magnetic-material-filled layer 2*a* are preferably made of Li ferrite or Mg ferrite whose magnetic properties change little by stress, more preferably Li ferrite, because they receive stress from the coil patterns, the magnetic gap layers, the external electrodes, etc. To reduce core loss, Ni ferrite is preferable.

(2) Operation Principle

In the laminate device of the present invention, the magnetic gap layers 4 each in contact with each coil pattern 3 are discontinuous. It has been considered that all magnetic fluxes should ideally flow through loops including pluralities of coils patterns, and that a magnetic flux through a small loop around each coil pattern is merely a leaked magnetic flux lowering inductance. In the present invention, however, among magnetic fluxes φa, φa' generated from the coil patterns 3*a*, 3*b* (each flowing through the magnetic material 2 and each magnetic gap layer 4*a*, 4*b* around each coil pattern 3*a*, 3*b*), a magnetic flux φb (flowing around both coil patterns 3*a*, 3*b*), and a magnetic flux φc (flowing around the coil patterns 3*a*, 3*b* and other coil patterns), magnetic fluxes φb and φc are reduced by the magnetic gap layers 4*a*, 4*b* in contact with each coil pattern 3*a*, 3*b*, leaving substantially only the magnetic fluxes φa, φa', as shown in FIG. 3.

The magnetic flux φa around the coil pattern 3*a* and the magnetic flux φa' around the coil pattern 3*b* share a magnetic material portion between the coil patterns 3*a*, 3*b* as a magnetic path. Because the magnetic fluxes φa, φa' are directed oppositely in the magnetic material portion between the coil patterns 3*a*, 3*b*, a DC magnetic field is cancelled, failing to obtain large inductance, but local magnetic saturation is unlikely to occur by large magnetization current, Because only a slight magnetic flux crosses other coil patterns, the inductance obtained is the total inductance of the coil patterns 3, stable in a range from a small magnetization current to a large magnetization current.

Figure 7:
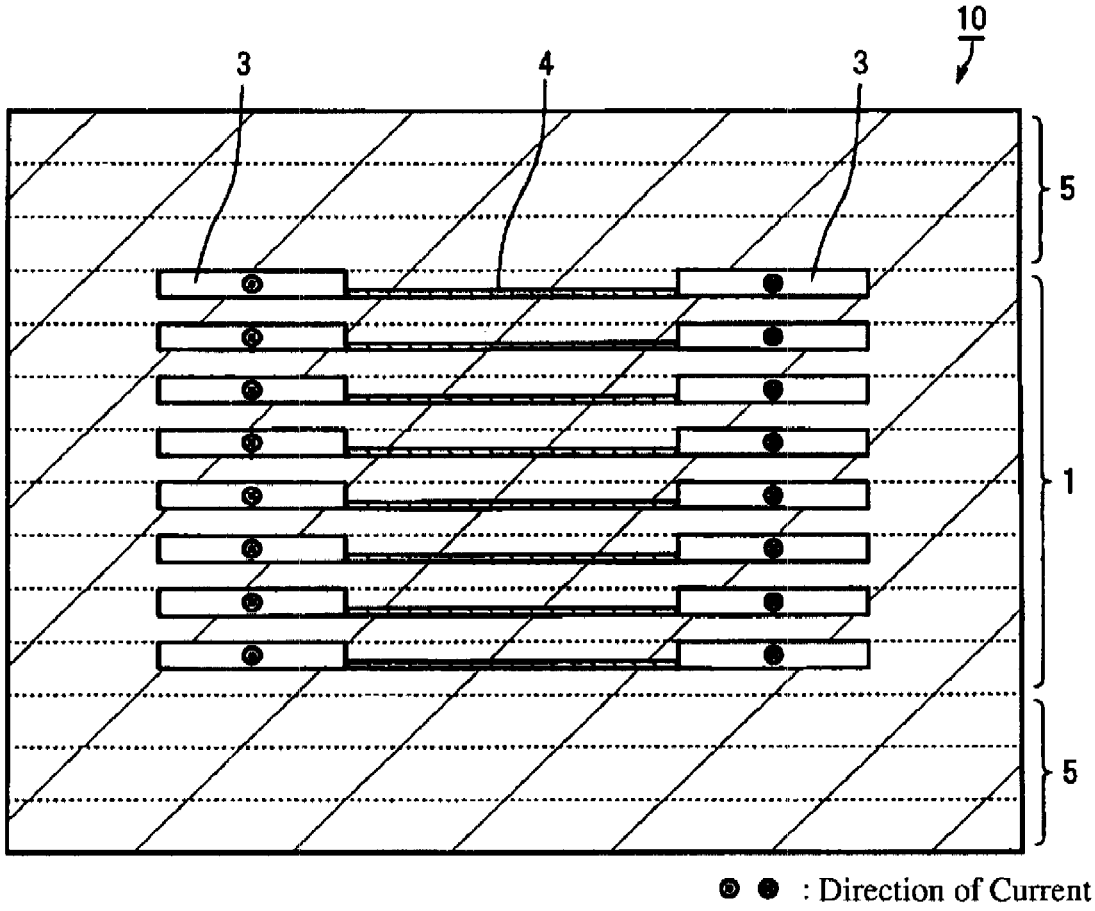
FIG. 7 is a cross-sectional view showing another example of the first laminate devices of the present invention.
Figure 8:
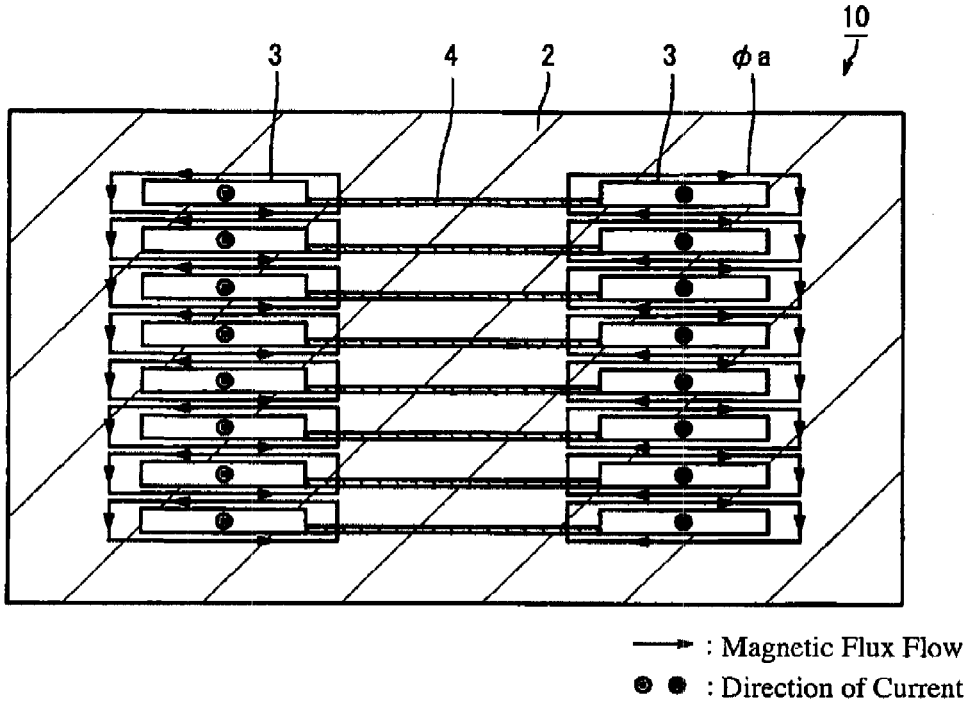
FIG. 8 is a schematic view showing a magnetic flux flow in another example of the first laminate devices of the present invention.

FIG. 7 shows a laminate device comprising an eight-layer coil part 1, and FIG. 8 schematically shows a magnetic flux in this laminate device. With magnetic gap layers 4 in contact with each coil pattern 3, a magnetic flux φa generated from each coil pattern 3 flows around it regardless of the number of layers.

Because the laminate device of the present invention has a reduced large-loop magnetic flux with less magnetic flux leaking outside, thin magnetic material parts can be formed on both upper and lower sides of the coil part 1. In an inductor array comprising pluralities of coils in each laminate device, magnetic coupling between the coils can be reduced.

[2] Second Laminate Device

Figure 9:
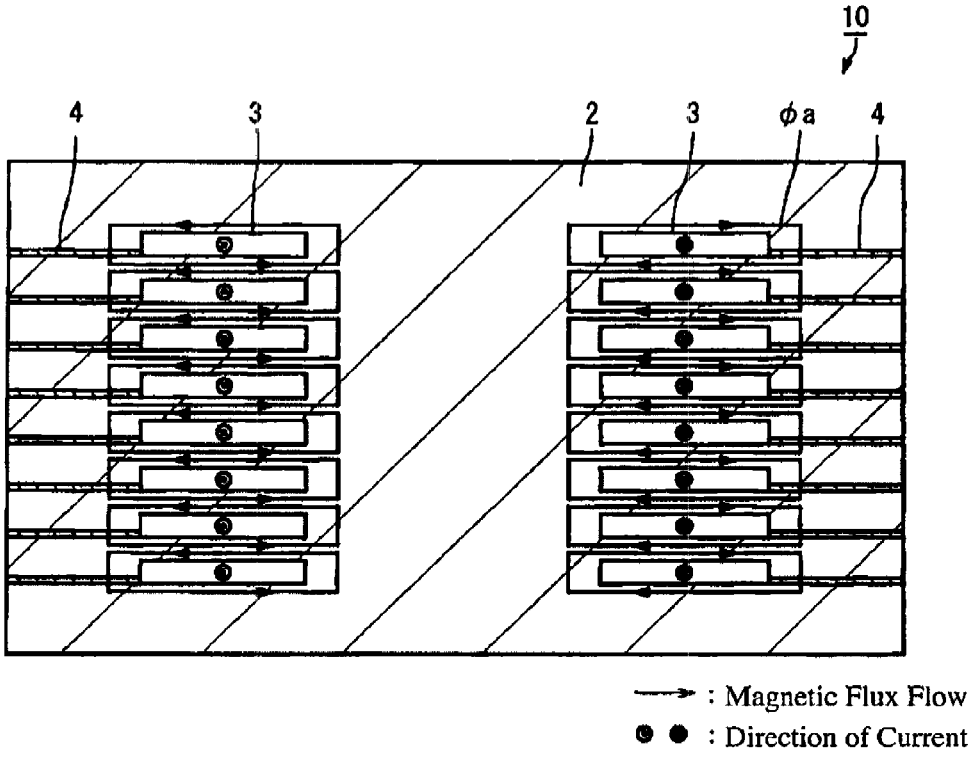
FIG. 9 is a schematic view showing a magnetic flux flow in the second laminate device of the present invention.
Figure 10A:
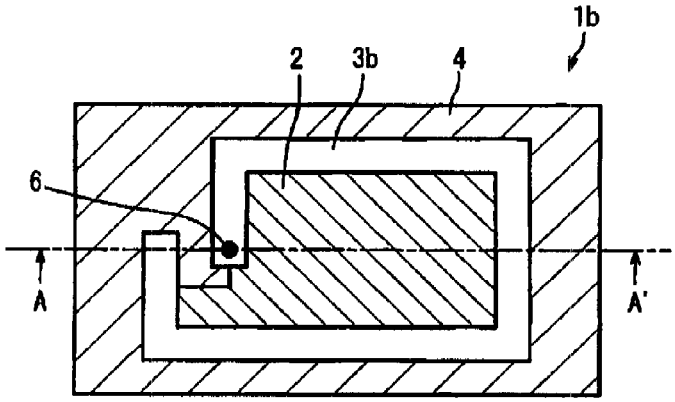
FIG. 10(*a*) is a plan view showing another magnetic layer used in the second laminate device of the present invention.
Figure 10B:
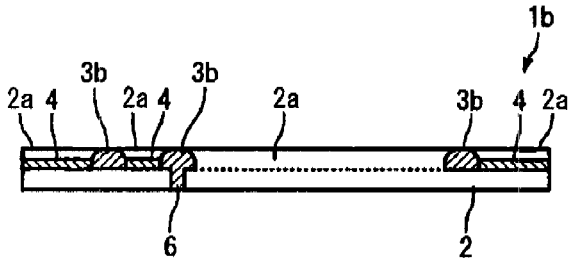

FIG. 9 shows a cross section of the second laminate device, and FIGS. 10(*a*) and 10(*b*) show a coil-pattern-carrying layer used in this laminate device. Because this laminate device has substantially the same structure as that of the first laminate device, explanation will be made only on their differences, with the explanation of the same portions omitted.

The coil-pattern-carrying layer 1*b* comprises a coil pattern 3 formed on a magnetic substrate layer 2, a magnetic gap layer 4 covering an entire region outside the coil pattern 3 in contact therewith, and a magnetic-material-filled layer 2*a* formed inside the coil pattern 3. For clarity, FIG. 10(*a*) shows a state before the magnetic-material-filled layer 2*a* covering the magnetic gap layer 4 is formed, and FIG. 10(*b*) shows a state after the magnetic-material-filled layer 2*a* is formed. The same is true in subsequent explanations. The second laminate device exhibits excellent DC-superimposed characteristics, because a magnetic flux around each coil pattern 3 passes through the magnetic gap layer 4, with magnetic fluxes crossing other coil patterns reduced.

[3] Third Laminate Device

Figure 11:
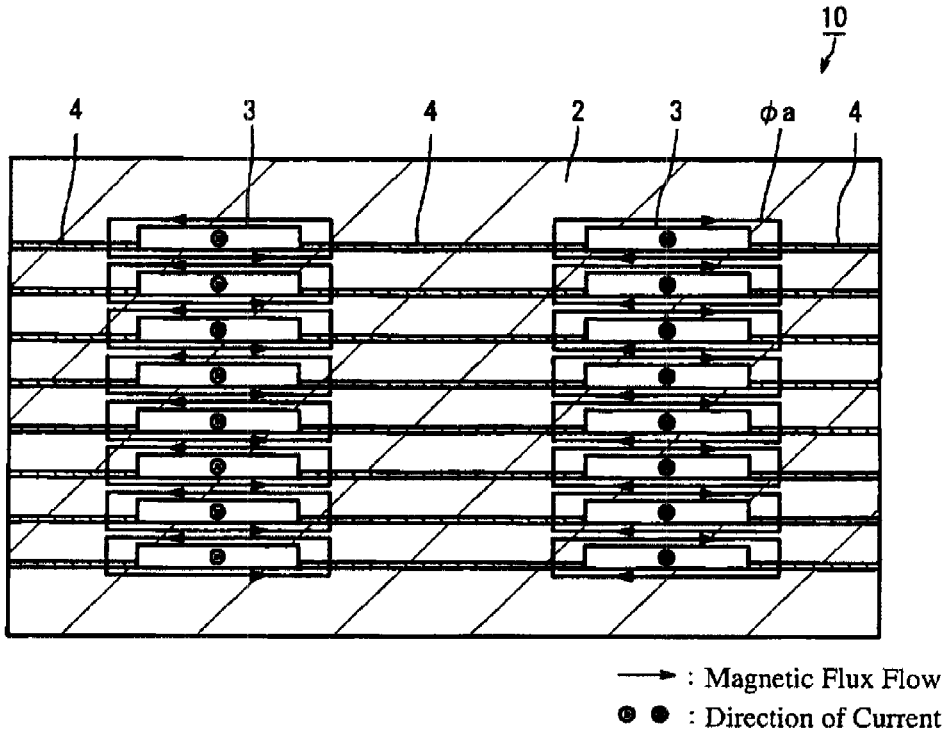
FIG. 11 is a schematic view showing a magnetic flux flow in the third laminate device of the present invention.
Figure 12A:
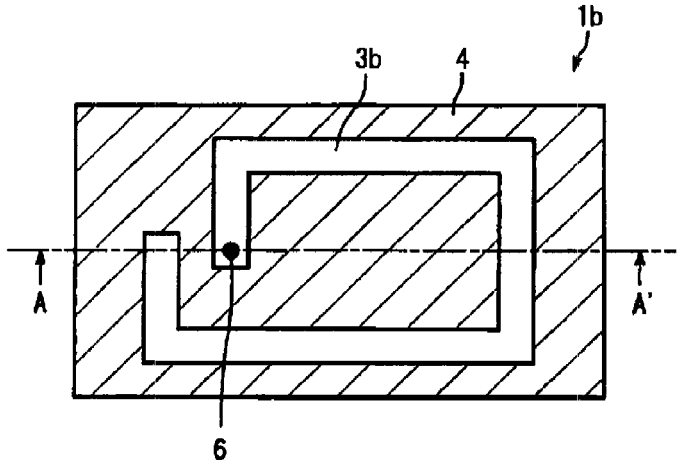
FIG. 12(*a*) is a plan view showing another magnetic layer used in the third laminate device of the present invention.
Figure 12B:
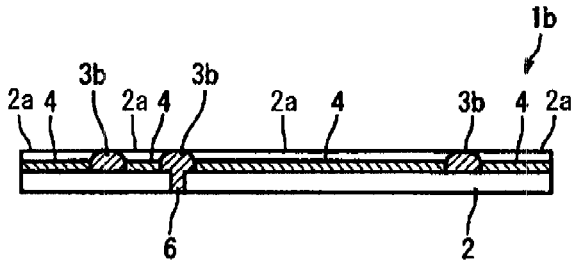

FIG. 11 shows a cross section of the third laminate device, and FIGS. 12(*a*) and 12(*b*) show a coil-pattern-carrying layer used in this laminate device. This coil-pattern-carrying layer comprises a magnetic gap layer 4 covering an entire region inside and outside a coil pattern 3*b*, a region excluding the coil pattern 3 being printed with a magnetic paste to form a magnetic-material-filled layer 2*a* [FIG. 12(*b*)]. Because the third laminate device has a longer magnetic gap than those of the first and second laminate devices, it has low inductance but a reduced magnetic flux crossing other coil patterns, thereby exhibiting excellent DC-superimposed characteristics.

[4] Fourth Laminate Device

Figure 13:
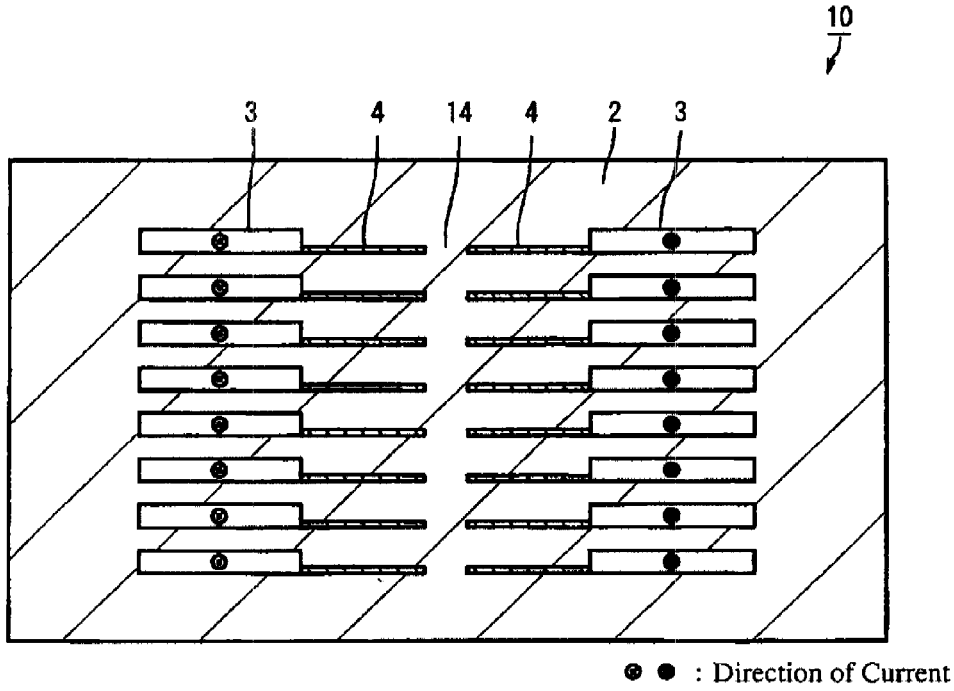
FIG. 13 is a cross-sectional view showing the fourth laminate device of the present invention.
Figure 14A:
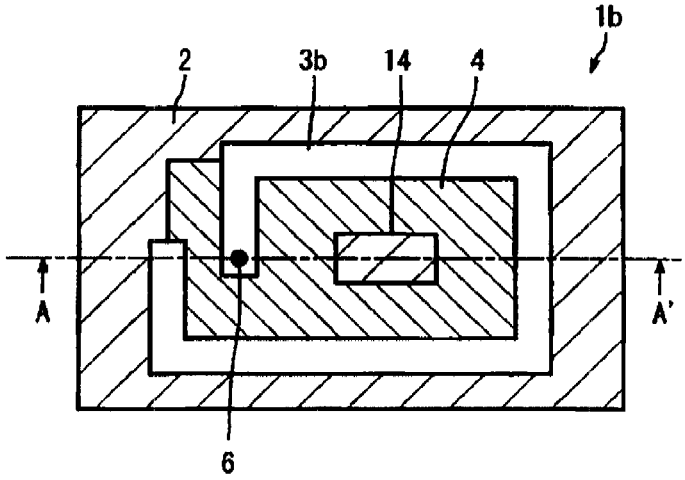
FIG. 14(*a*) is a plan view showing another magnetic layer used in the fourth laminate device of the present invention.
Figure 14B:
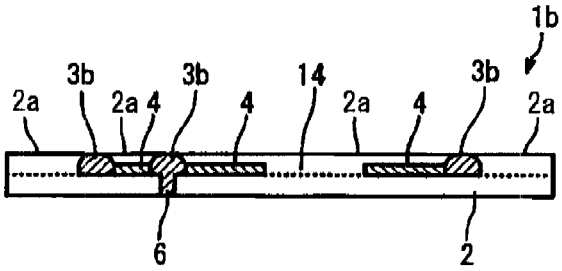
Figure 15:
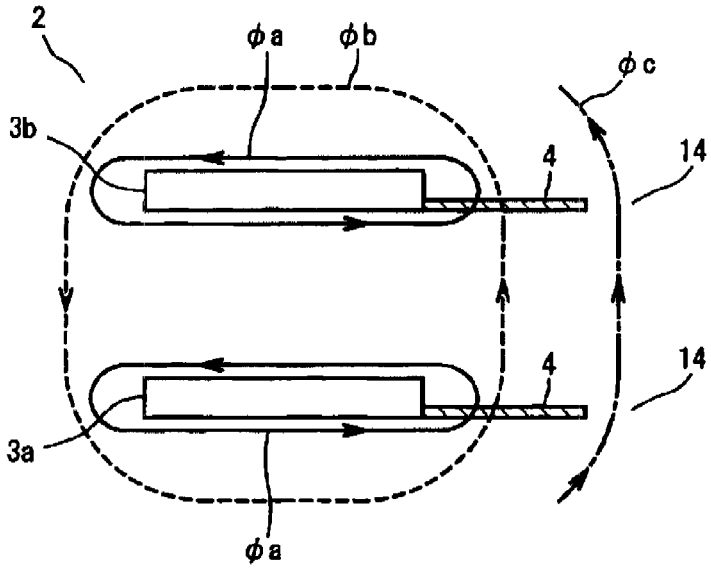
FIG. 15 is a schematic view showing a magnetic flux flow in the fourth laminate device of the present invention.

FIG. 13 shows a cross section of the fourth laminate device, FIGS. 14(*a*) and 14(*b*) show one magnetic layer used in this laminate device, and FIG. 15 shows a magnetic field distribution in this laminate device. In a coil-pattern-carrying layer 1*b* used in this laminate device, a magnetic-material-filled layer 2*a* is disposed in an opening 14 of a magnetic gap layer 4. The area of the opening 14 and the magnetic properties of a magnetic material filled in the opening 14 are properly selected such that a small magnetization current magnetically saturates the opening 14 more easily than a magnetic material portion between the coil patterns.

Figure 16:
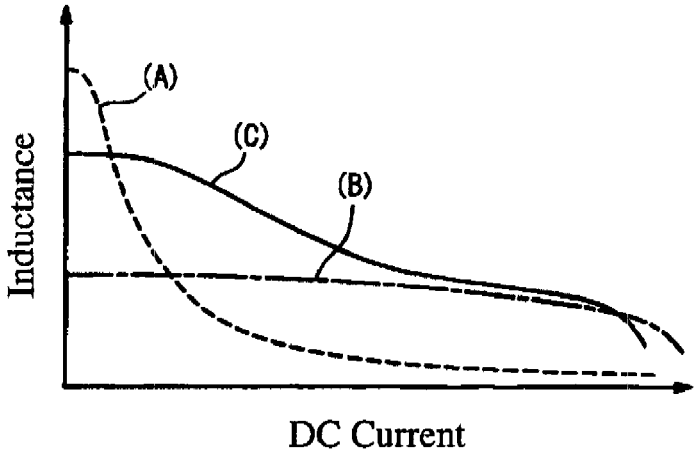
FIG. 16 is a graph showing the DC-superimposed characteristics of a conventional laminate device and the first and fourth laminate devices of the present invention.
Figure 47:
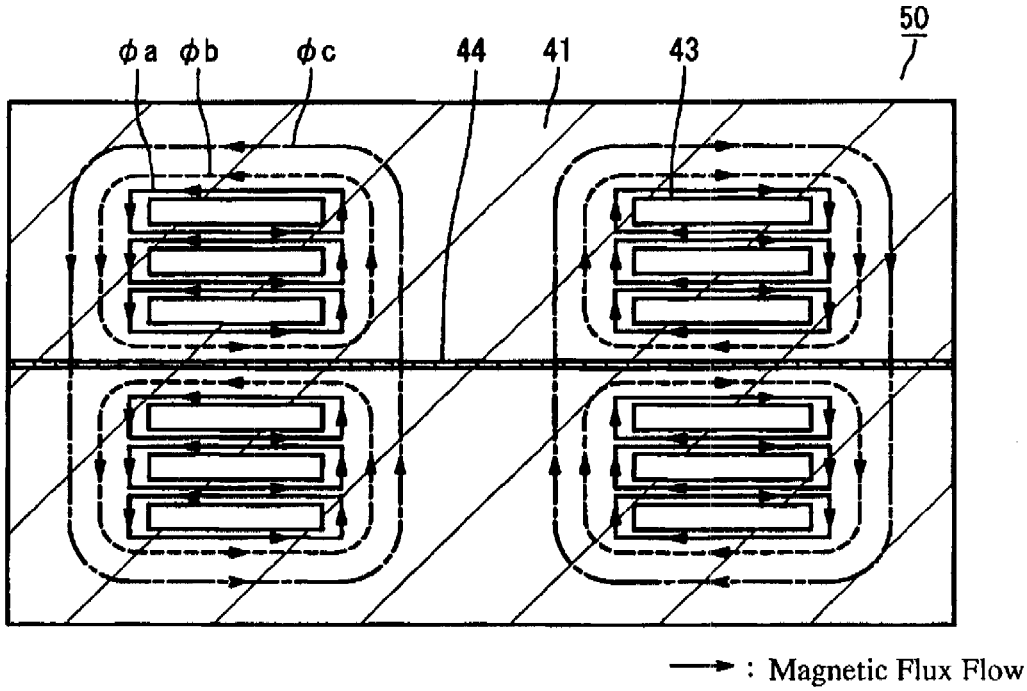
FIG. 47 is a cross-sectional view showing an example of conventional laminated inductors.
Figure 48:
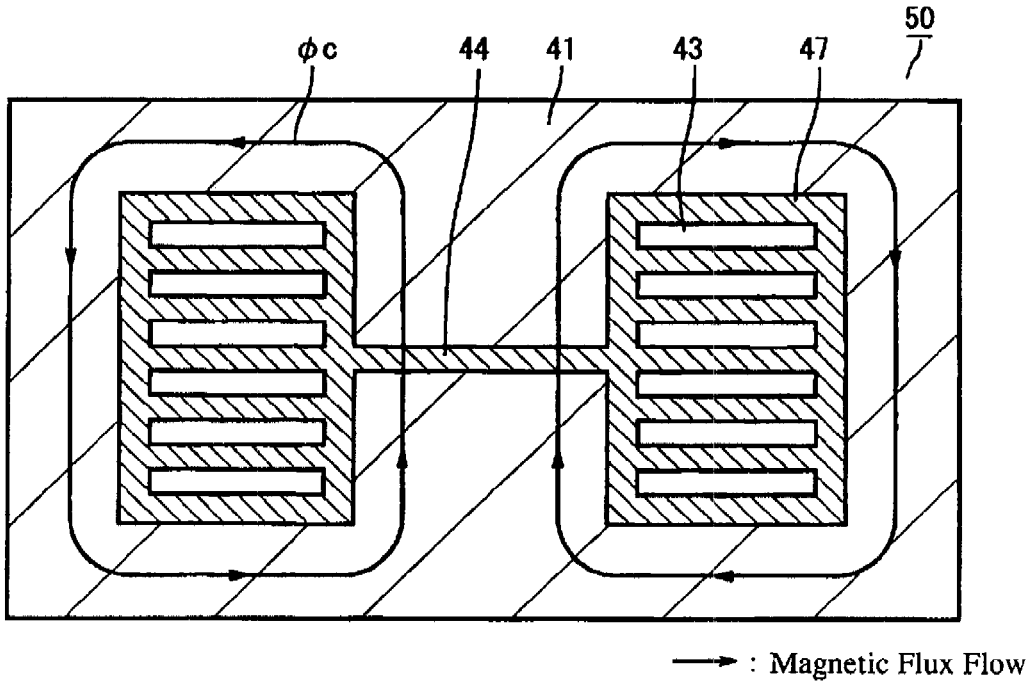
FIG. 48 is a cross-sectional view showing another example of conventional laminated inductors.

FIG. 16 shows the DC-superimposed characteristics of a conventional laminate device (A), the first laminate device (B) and the fourth laminate device (C). The conventional laminate device is a laminated inductor shown in FIG. 47, which has only one center magnetic gap layer. The fourth laminate device exhibits larger inductance than that of the first laminate device at a small magnetization current by a magnetic flux $\phi c$ passing through an opening 14. Such DC-superimposed characteristics can suppress a current ripple that poses problems at a small magnetization current. After the magnetic-material-filled layer in the opening 14 is magnetically saturated, the opening 14 functions as a magnetic gap, resulting in decrease in a magnetic flux $\phi c$ and thus the same magnetic field distribution as in the first laminate device. Accordingly, magnetic saturation is unlikely to occur until reaching a large magnetization current, thereby exhibiting better DC-superimposed characteristics than those of the conventional laminated inductor.

Figure 17:
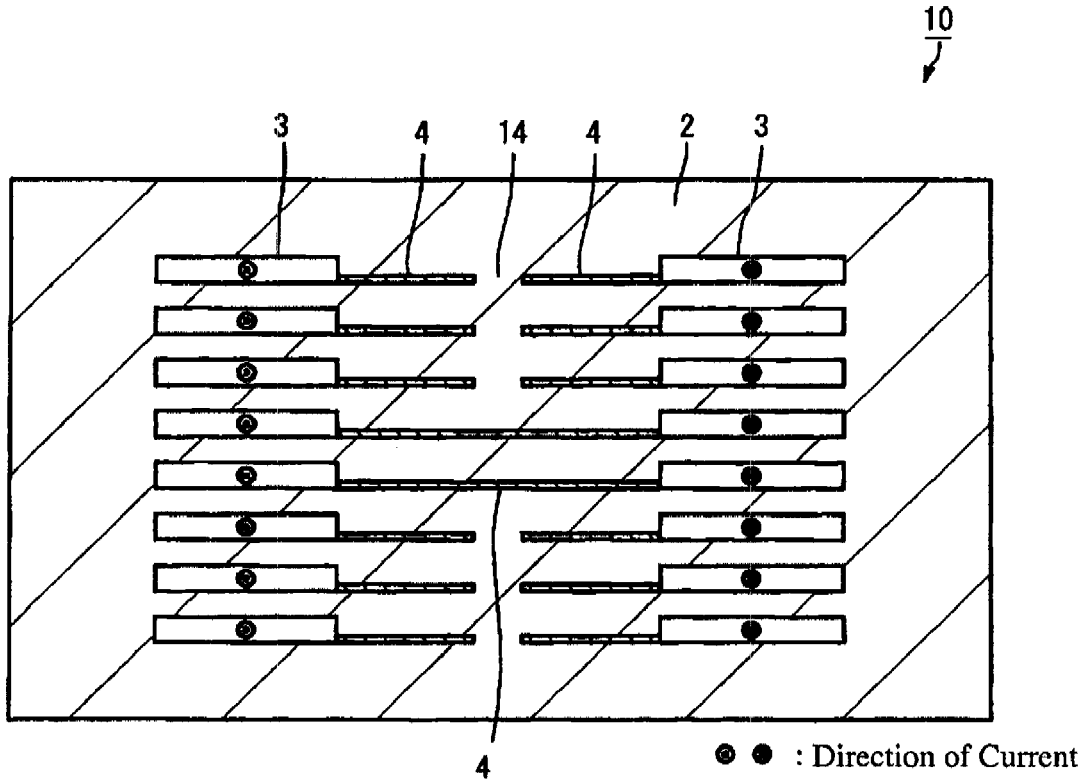
FIG. 17 is a cross-sectional view showing another example of the fourth laminate devices of the present invention.
Figure 18:
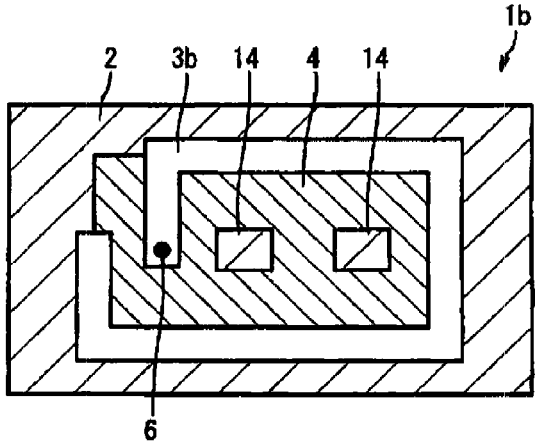
FIG. 18 is a plan view showing another magnetic layer used in the fourth laminate device of the present invention.
Figure 19:
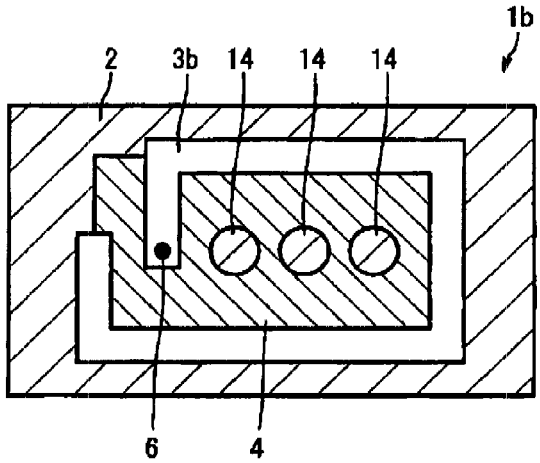
FIG. 19 is a plan view showing a further magnetic layer used in the fourth laminate device of the present invention.

Although all magnetic gap layers have openings 14 in the fourth laminate device, openings 14 may be formed only in some of the magnetic gap layers as shown in FIG. 17. As shown in FIGS. 18 and 19, one magnetic gap layer may have pluralities of openings 14, whose shapes, positions, areas and numbers are not restricted. With the shape of the opening 14 changed, a laminate device having desired magnetic properties can be obtained.

[5] Fifth Laminate Device

Figure 20:
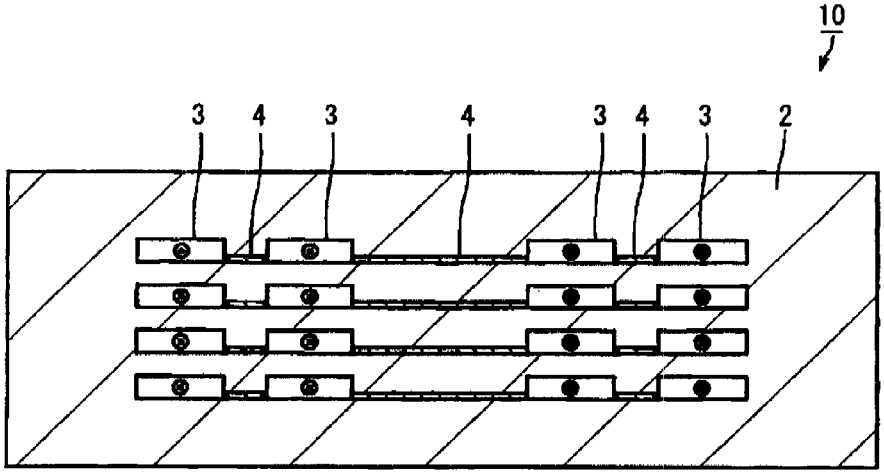
FIG. 20 is a cross-sectional view showing the fifth laminate device of the present invention.
Figure 21A:
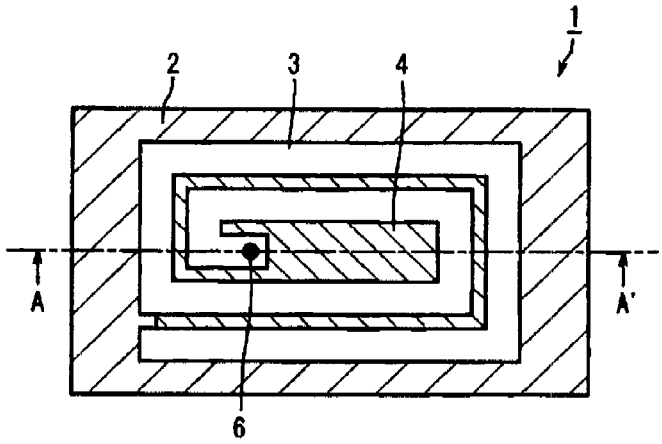
FIG. 21(*a*) is a plan view showing another magnetic layer used in the fifth laminate device of the present invention.
Figure 21B:
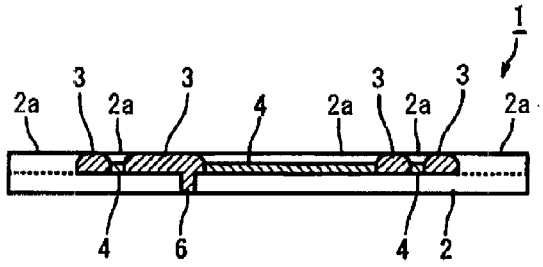
Figure 22:
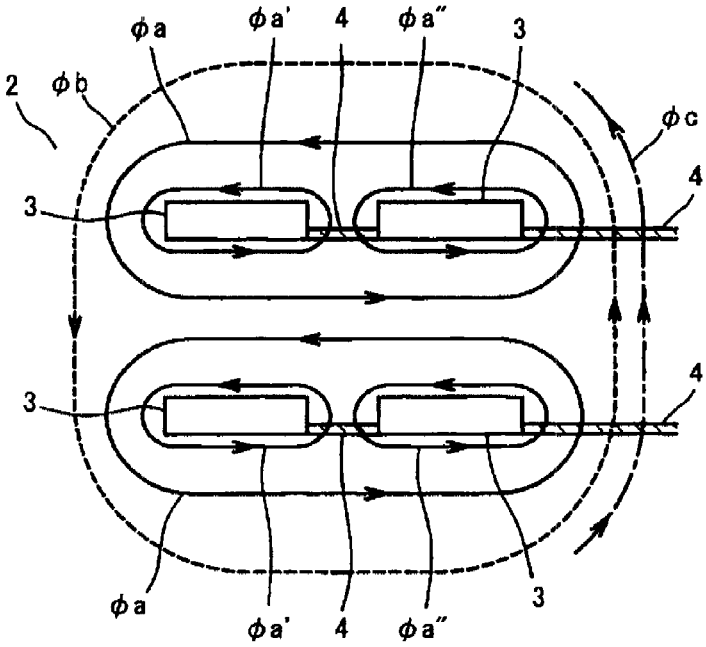
FIG. 22 is a schematic view showing a magnetic flux flow in the fifth laminate device of the present invention.

FIG. 20 shows a cross section of the fifth laminate device, FIGS. 21(*a*) and 21(*b*) show a coil-pattern-carrying layer used in this laminate device, and FIG. 22 shows a magnetic field distribution in this laminate device. In this coil-pattern-carrying layer; each layer has more than one turn of a coil pattern with a magnetic gap layer 4 disposed between adjacent patterns. Each magnetic flux $\phi a'$, $\phi a''$ flows through a small loop around part of each coil pattern 3, and a magnetic flux $\phi a$ flows through a loop around the entire coil pattern 3. Because there is magnetic coupling between the coils on the same layer, larger inductance is obtained than when one-turn coil patterns are formed.

This laminate device also has less magnetic flux crossing coil patterns on other layers, thereby exhibiting excellent DC-superimposed characteristics together with large inductance. Also, because of a reduced number of layers in the coil part 1, the laminate device can be made thinner.

[6] Sixth Laminate Device

Figure 23:
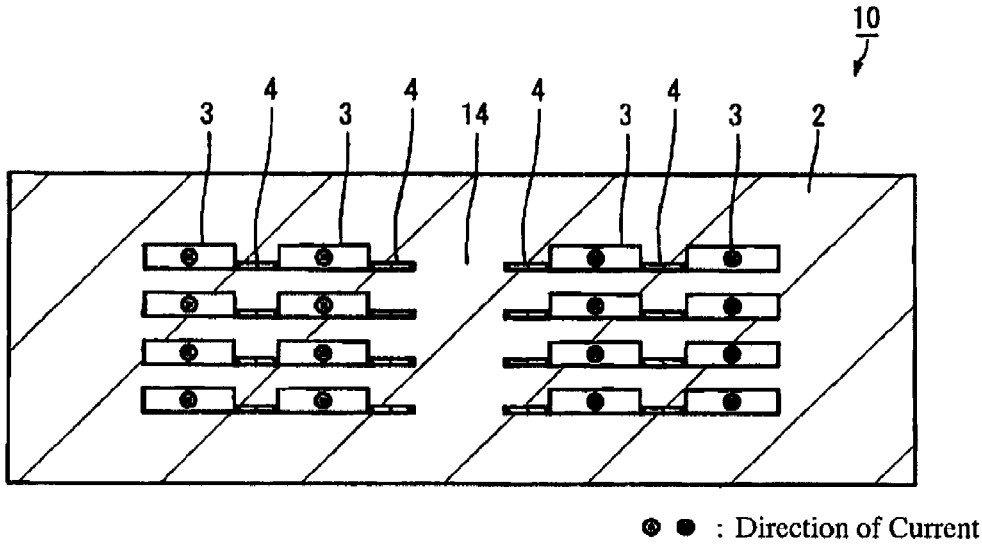
FIG. 23 is a cross-sectional view showing the sixth laminate device of the present invention.
Figure 24A:
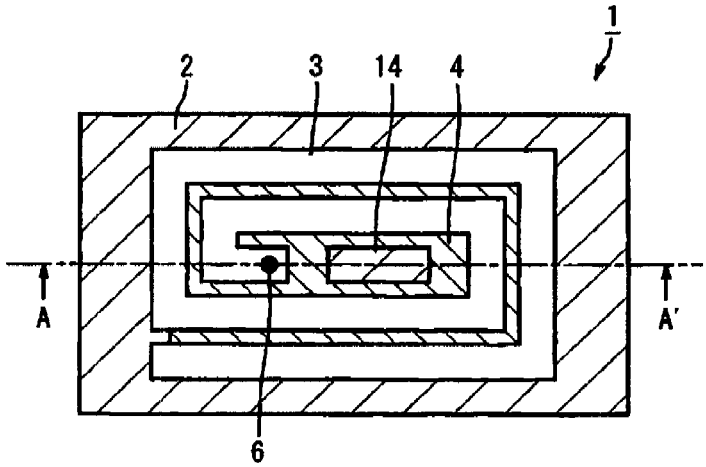
FIG. 24(*a*) is a plan view showing another magnetic layer used in the sixth laminate device of the present invention.
Figure 24B:
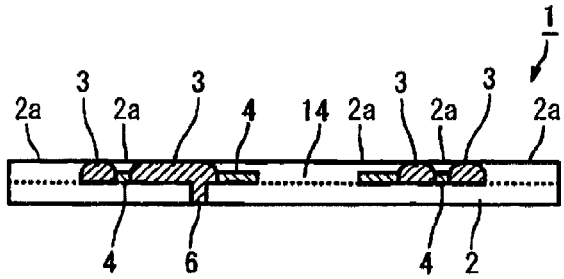

FIG. 23 shows a cross section of the fifth laminate device, and FIGS. 24(*a*) and 24(*b*) show a coil-pattern-carrying layer used in this laminate device. This laminate device also has a magnetic-material-filled layer formed in an opening 14 provided in part of a magnetic gap layer 4. This laminate device also exhibits excellent DC-superimposed characteristics together with large inductance.

[7] Seventh Laminate Device

Figure 25:
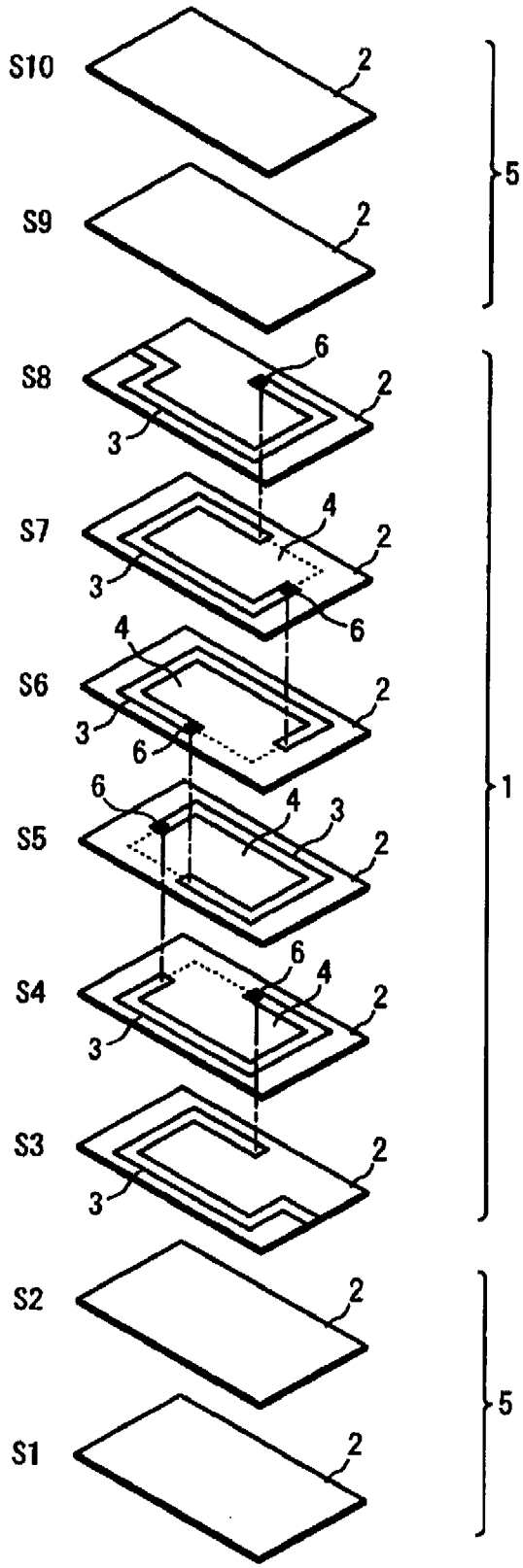
FIG. 25 is an exploded perspective view showing the seventh laminate device of the present invention.
Figure 26:
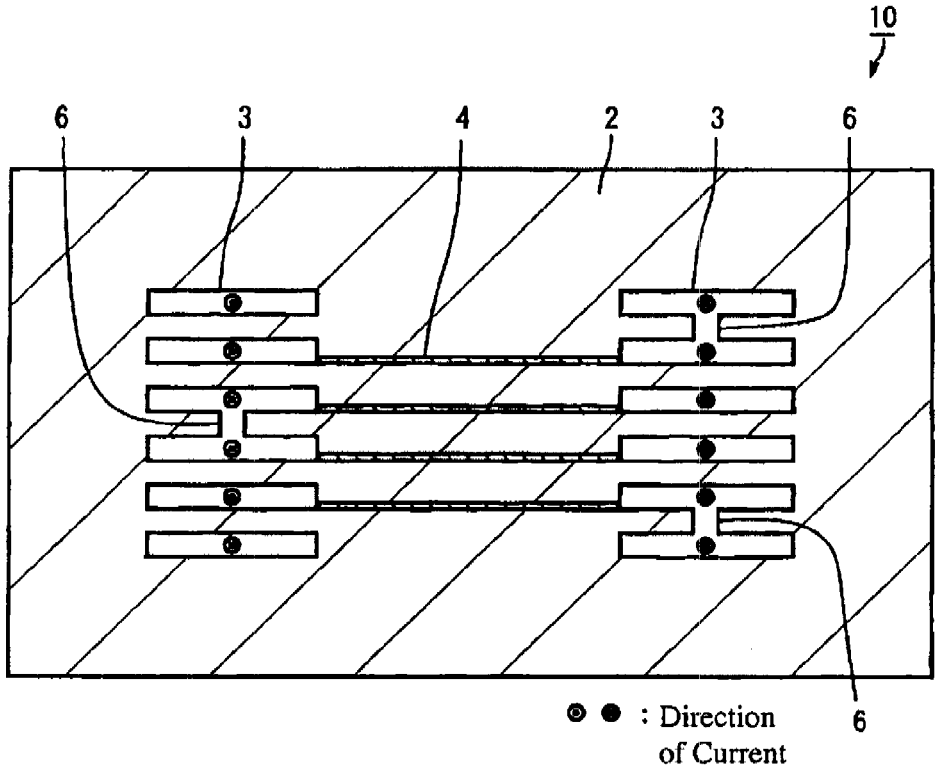
FIG. 26 is a cross-sectional view showing the seventh laminate device of the present invention.

FIG. 25 shows layers constituting the seventh laminate device, and FIG. 26 is its cross-sectional view. Each coil pattern 3 has 0.75 turns, and a 4.5-turn coil is formed in the entire laminate device. Accordingly, the coil part 1 has 10 coil-pattern-carrying layers (S1-S10), more than in the first laminate device.

This laminate device does not have magnetic gap layers 4 in uppermost and lowermost layers (S8, S3) in the coil part 1, but has them in all intermediate layers (S4-S7) (corresponding to ⅔ of the number of turns of the coil), thereby exhibiting excellent DC-superimposed characteristics.

[8] Eighth Laminate Device

Figure 27:
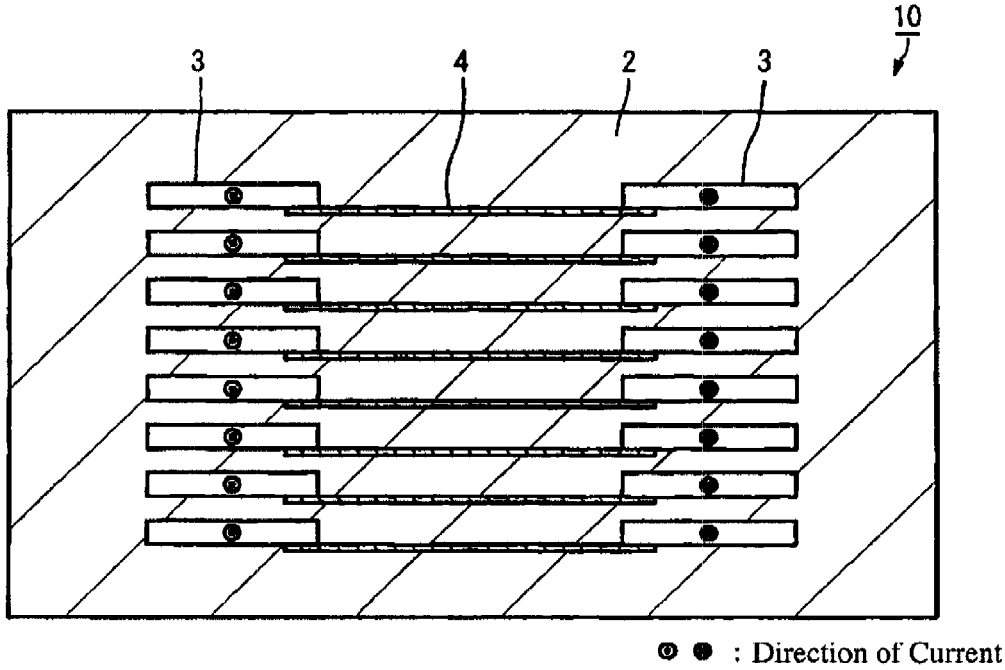
FIG. 27 is a cross-sectional view showing the eighth laminate device of the present invention.
Figure 28:
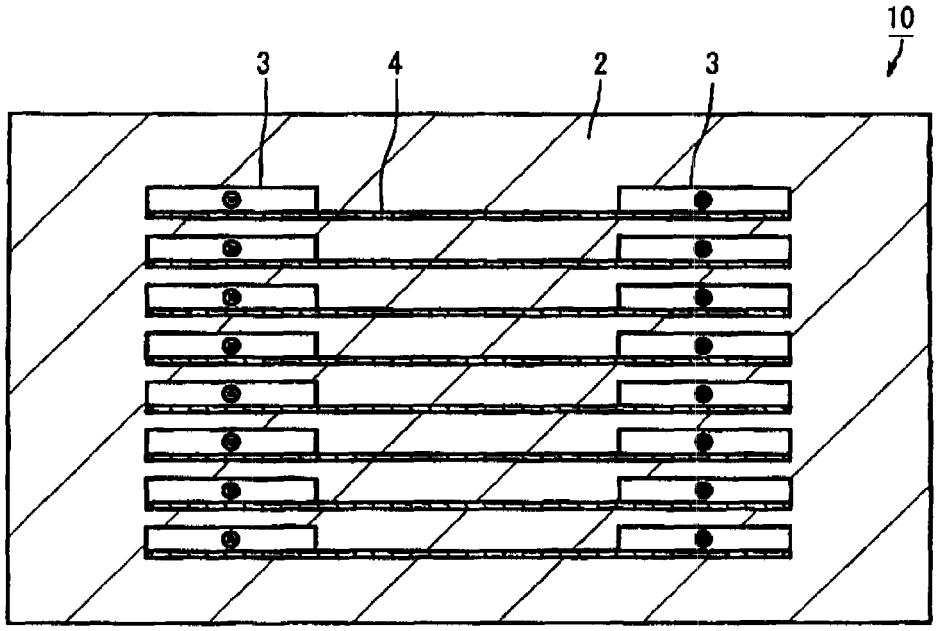
FIG. 28 is a cross-sectional view showing another example of the eighth laminate devices of the present invention.
Figure 29:
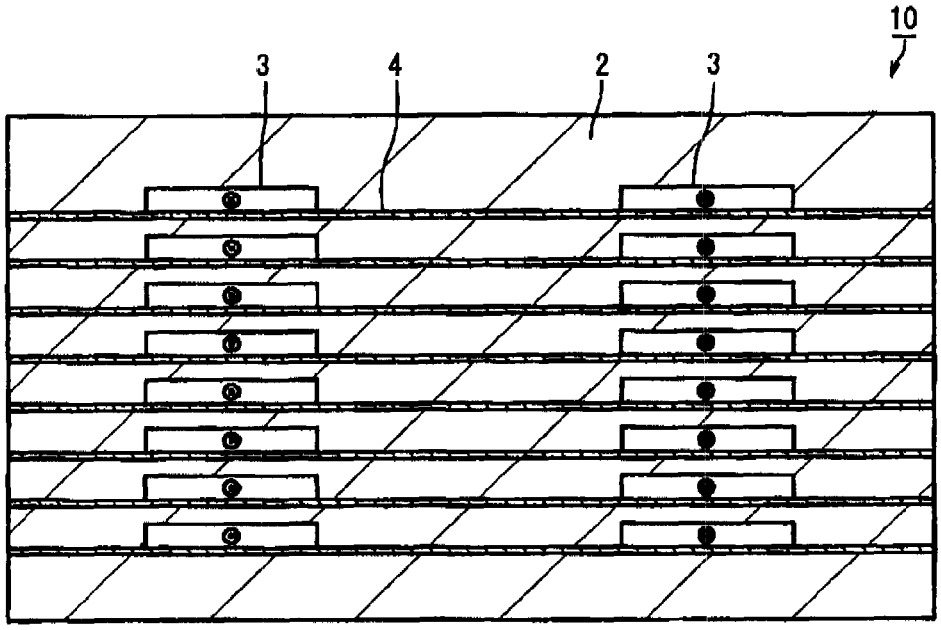
FIG. 29 is a cross-sectional view showing a further example of the eighth laminate devices of the present invention.

FIGS. 27 to 29 show an eighth laminate device. The eighth laminate device comprises magnetic gap layers overlapping coil patterns in a lamination direction. In the laminate device shown in FIG. 27, the magnetic gap layers 4 overlap part of the coil patterns 3. In the laminate device shown in FIG. 28, the magnetic gap layers 4 overlap the entire coil patterns 3. In the laminate device shown in FIG. 29, the magnetic gap layers 4 cover the entire surfaces of the magnetic substrate layers 2. The eighth laminate device may have openings 14 in the magnetic gap layers 4. Although the magnetic gap layers 4 make the laminate device thicker, the laminate device has excellent DC-superimposed characteristics.

[9] Ninth Laminate Device

Figure 30:
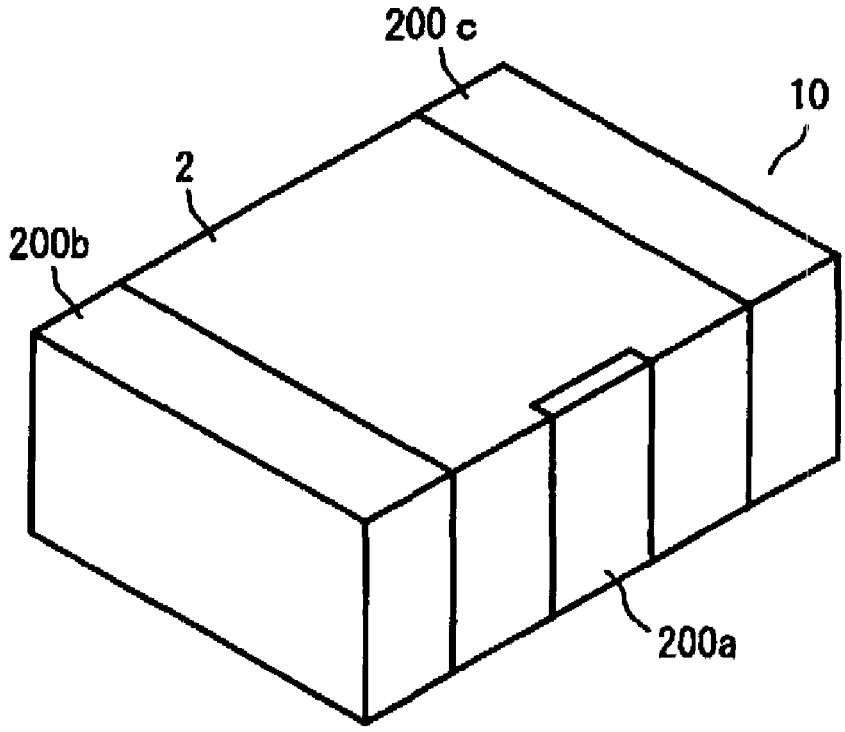
FIG. 30 is a perspective view showing the appearance of the ninth laminate device of the present invention.
Figure 31:
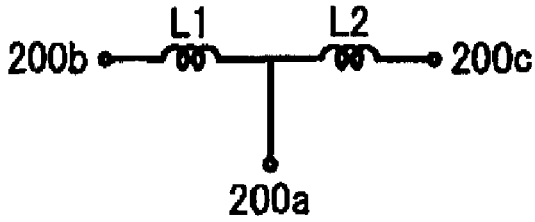
FIG. 31 is a view showing the equivalent circuit of the ninth laminate device of the present invention.
Figure 32:
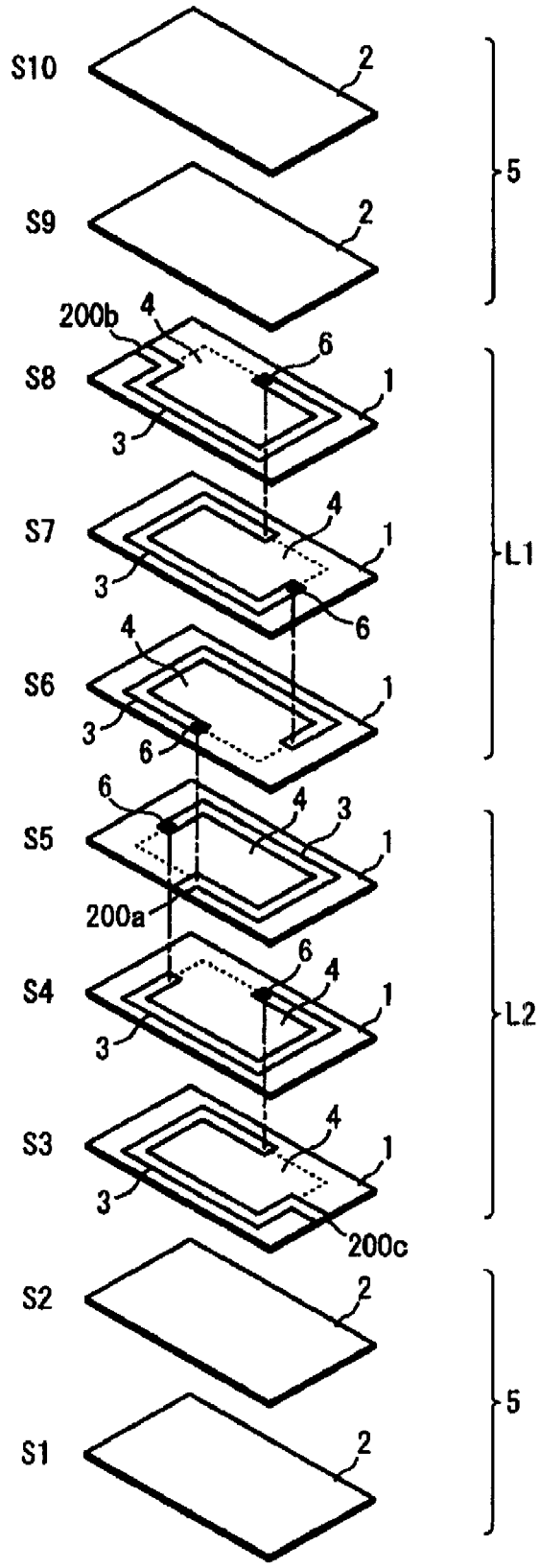
FIG. 32 is in exploded perspective view showing the ninth laminate device of the present invention.
Figure 33:
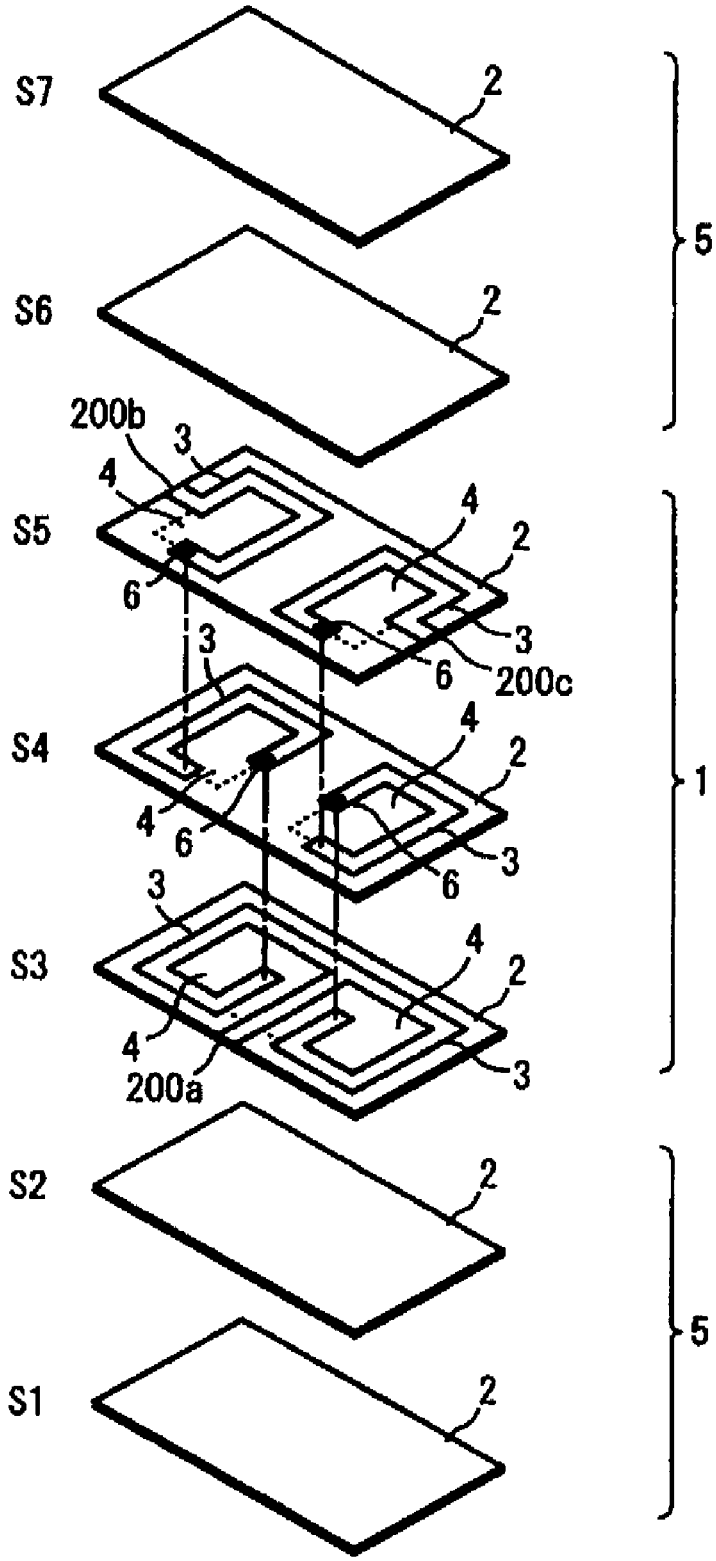
FIG. 33 is m exploded perspective view showing another example of the ninth laminate devices of the present invention.

FIG. 30 shows the appearance of a laminate device having pluralities of inductors (inductor array), FIG. 31 shows its equivalent circuit, and FIGS. 32 and 33 show its internal structure. This laminate device, which has an intermediate tap in a coil constituted by laminated coil patterns 3 to divide the coil to two coils with different winding directions, may be used for multi-phase DC-DC converters.

This laminate device comprises external terminals 200*a*-200*c*, the external terminal 200*a* being the intermediate tap. An inductor L1 is formed between the external terminals 200*a* and 200*b*, and an inductor L2 is formed between the external terminals 200*a* and 200*c*. The laminate device shown in FIG. 32 is constituted by laminating the inductors L1, L2 each formed by a 2.5-turn coil. Because the ninth laminate device comprises magnetic gap layers 4 as in the above embodiments, the inductors L1, L2 have excellent DC-superimposed characteristics with reduced magnetic coupling between the coils.

An inductor array shown in FIG. 33 comprises inductors L1, L2 each formed by a 2.5-turn coil, which are disposed in a plane. This inductor array also exhibits excellent DC-superimposed characteristics. An intermediate tap may be omitted with coil ends connected to different external terminals. This application is not restricted to multi-phase DC-DC converters.

[10] DC-DC Converter Module

Figure 34:
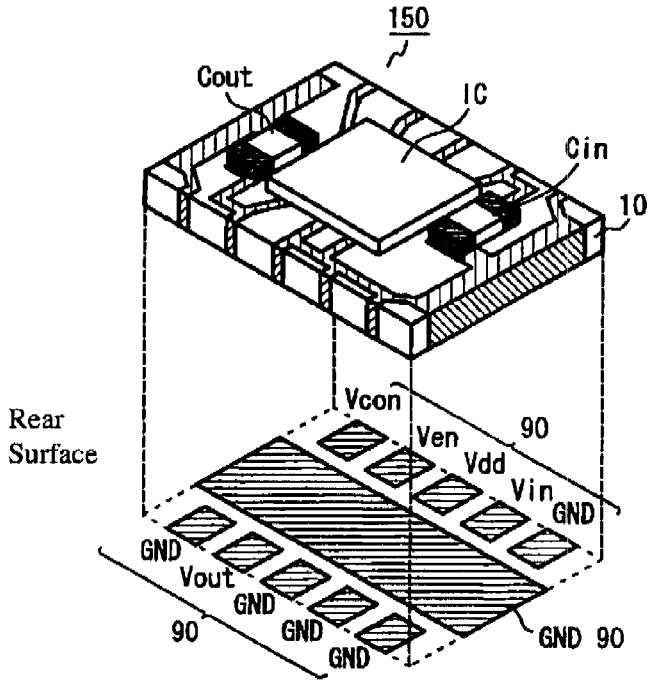
FIG. 34 is a perspective view showing the appearance of the module of the present invention.
Figure 35:
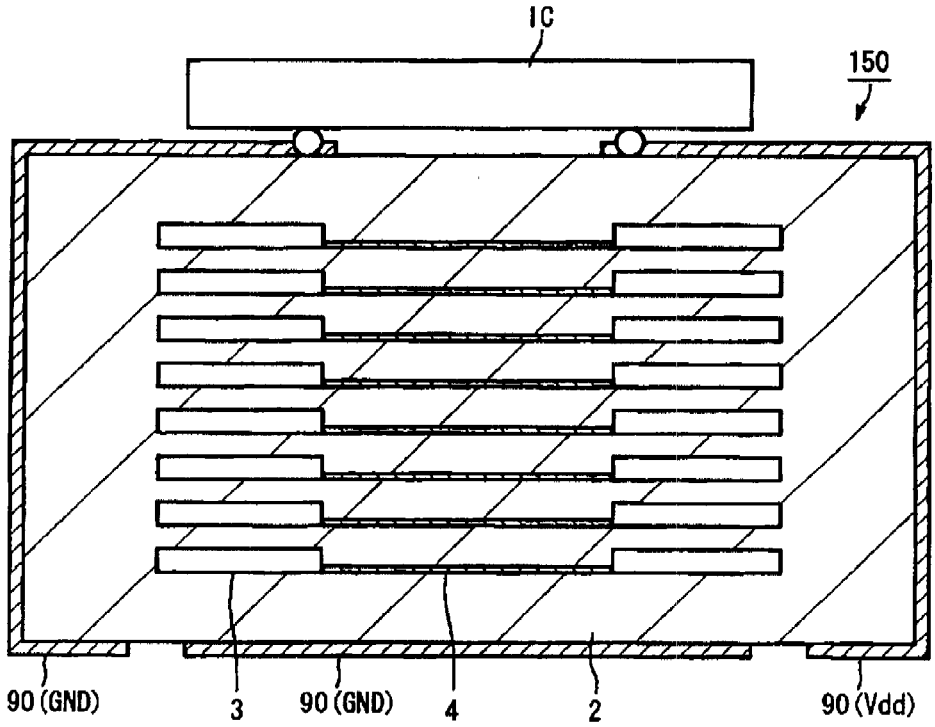
FIG. 35 is a cross-sectional view showing the module of the present invention.
Figure 36:
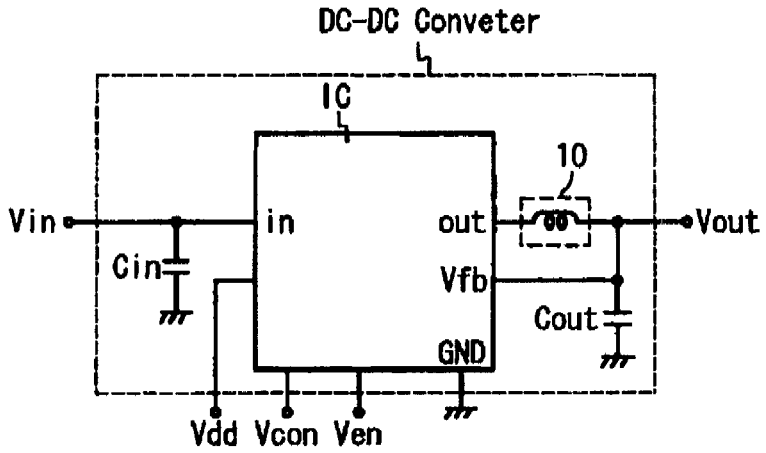
FIG. 36 is a block diagram showing the circuit of the module of the present invention.

FIG. 34 shows the appearance of a DC-DC converter module comprising the laminate device of the present invention, FIG. 35 shows its cross section, and FIG. 36 shows its equivalent circuit. This DC-DC converter module is a step-down DC-DC converter comprising a laminate device 10 containing an inductor, on which an integrated semiconductor part IC including a switching device and a control circuit and capacitors Cin, Cout are mounted. The laminate device 10 has pluralities of external terminals 90 on the rear surface, and connecting electrodes on the side surfaces, which are connected to the integrated semiconductor part IC and the inductor. The connecting electrodes may be formed by through-holes in the laminate device. Symbols given to the external terminals 90 correspond to those of the integrated semiconductor part IC connected, an external terminal Vcon being connected to an output-voltage-variable controlling terminal, an external terminal Ven being connected to a terminal for controlling the ON/OFF of an output, an external terminal Vdd being connected to a terminal for controlling the ON/OFF of a switching device, an external terminal Vin being connected to an input terminal, and an external terminal Vout being connected to an output terminal. An external terminal GND is connected to a ground terminal GND.

The laminate device 10 having magnetic gap layers 4 in contact with coil patterns 3 exhibits excellent DC-superimposed characteristics. Because only a slight magnetic flux leaks outside, the integrated semiconductor circuit IC may be disposed close to the inductor without generating noise in the integrated semiconductor circuit IC, thereby providing DC-DC converters with excellent conversion efficiency.

The DC-DC converter module may also be obtained by mounting the laminate device 10, an integrated semiconductor circuit IC, etc. on a printed circuit board or on a capacitor substrate containing capacitors Cin, Cout, etc.

Figure 37:
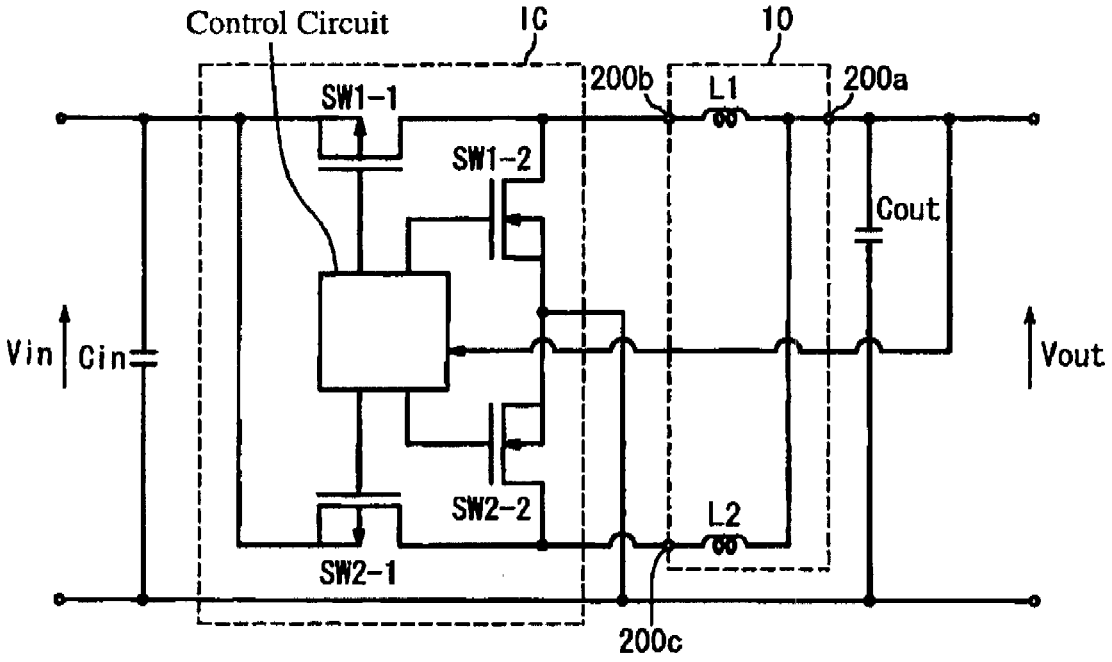
FIG. 37 is a block diagram showing the circuit of another example of the modules of the present invention.

Another example of DC-DC converter modules is a step-down, multi-phase DC-DC converter module having the equivalent circuit shown in FIG. 37, which comprises an input capacitor Cin, an output capacitor Cout, output inductors L1, L2, and an integrated semiconductor circuit IC including a control circuit CC. The above inductor array can be used as the output inductors L1, L2. This DC-DC converter module is usable with large magnetization current, exhibiting excellent conversion efficiency.

Figure 38:
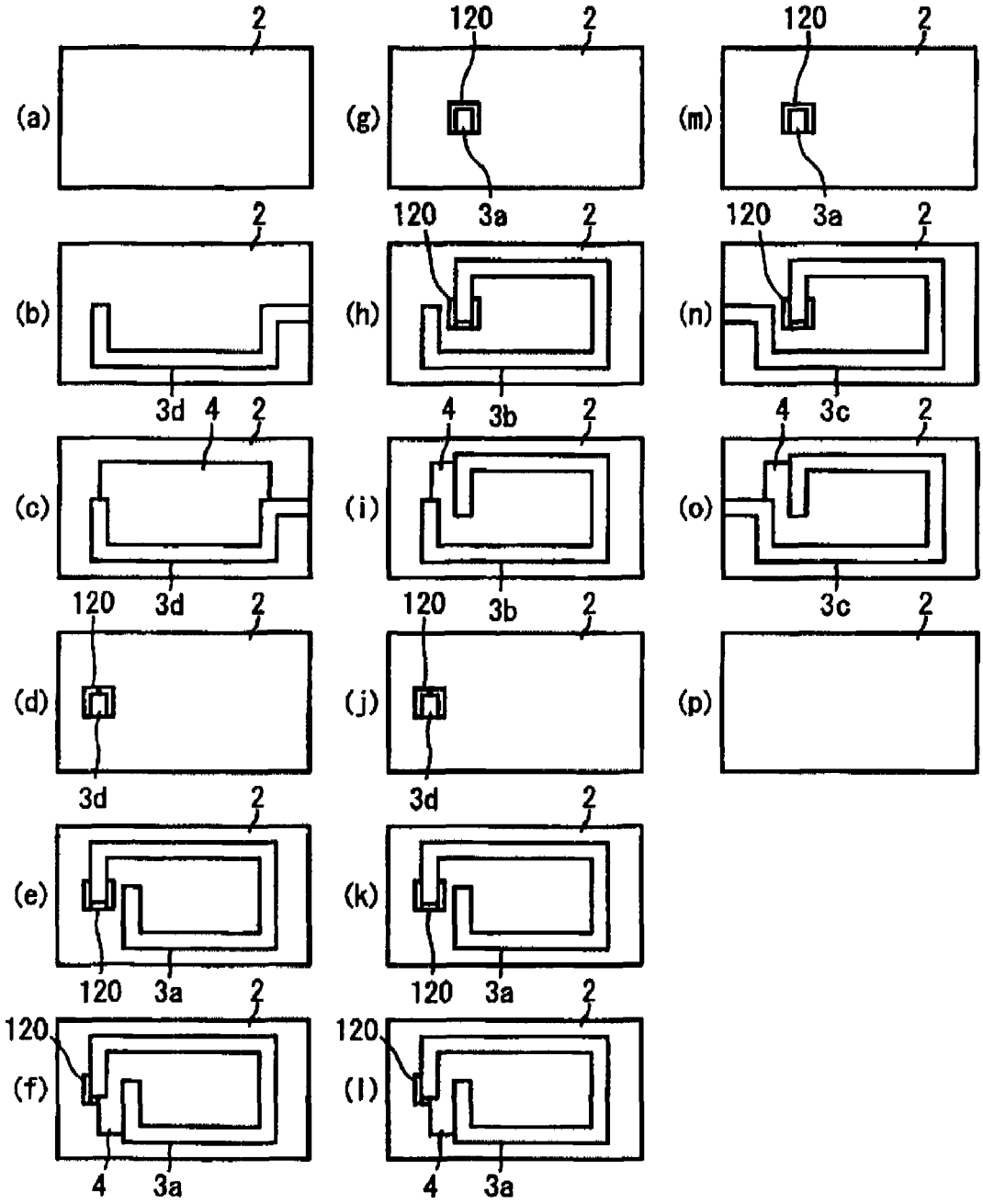
FIG. 38 is a plan view showing the production method of the first laminate device of the present invention.

Although the laminate devices are produced by a sheet-laminating method above, they can be produced by a printing method shown in FIGS. 38(*a*) to 38(*p*). The production of the laminate device of the present invention by printing comprises the steps of (a) printing a magnetic paste on a carrier film such as a polyester film, and drying it to form a first magnetic layer 2, (b) printing a conductive paste to form a coil pattern 3*d*, (c) printing a non-magnetic paste in a predetermined region to form a magnetic gap layer 4, (d) printing a magnetic paste in a portion excluding coil pattern ends to form a second magnetic layer 2, (e) printing a conductive paste above a portion of the coil pattern 3*d* appearing through an opening 120 to form a coil pattern 3*a*, (i) printing a non-magnetic paste to form a magnetic gap layer 4, and (g) printing a magnetic paste 2, the same steps [(i)-(p)] as above being repeated subsequently.

The present invention will be explained in more detail referring to Examples below without intention of restricting the scope of the present invention.

Example 1

(1) Production of First Laminate Device Shown in FIGS. 1 to 6 (Sample A of Example)

100 parts by weight of calcined Ni—Cu—Zn ferrite powder (Curie temperature Tc: 240° C., and initial permeability at a frequency of 100 kHz: 300) comprising 49.0% by mol of $Fe_2O_3$, 13.0% by mol of CuO, and 21.0% by mol of ZnO, the balance being NiO, was blended with 10 parts by weight of an organic binder based on polyvinyl butyral, a plasticizer and a solvent by a ball mill, to form a magnetic material slurry, which was formed into green sheets.

Some of the green sheets were provided with through-holes 6, and the green sheets having through-holes 6 and those without through-holes were printed with a non-magnetic zirconia paste for forming magnetic gap layers 4 in a predetermined pattern, and then printed with a conductive Ag paste for forming coil patterns 3.

To remove a step between the printed zirconia paste layer and the printed Ag paste layer, an imprinted region was printed with a paste of the same Ni—Cu—Zn ferrite as that of the green sheet to form magnetic-material-filled layers 2*a*-2*d*.

As shown in FIG. 4, coil-pattern-carrying layers 1*a*-1*d* each obtained by printing the magnetic substrate layer 2 with the zirconia paste and the Ag paste were laminated to form a coil part 1, in which a coil had a predetermined number of turns. Two magnetic substrate layers 2 each free from a printed zirconia paste layer and a printed Ag paste layer were laminated on upper and lower surfaces of the coil part 1, such that the resultant laminate had a predetermined overall size. The laminate was pressure-bonded, machined to a desired shape, and sintered at 930° C. for 4 hours in the air to obtain a rectangular sintered laminate of 2.5 mm×2.0 mm and 1.0 mm in thickness. This sintered laminate was coated with an Ag paste for external electrodes on its sides, and sintered at 630° C. for 15 minutes to produce a laminate device 10 (sample A) having a 6.5-turn coil, with each layer having a 3-μm-thick magnetic gap layer 4. After sintering, each ferrite layer had a thickness of 40 μm, each coil pattern had a thickness of 20 μm and a width of 300 μm, and a region inside the coil pattern was 1.5 mm×1.0 mm.

(2) Production of Sample B (Example)

Sample B was produced in the same manner as in Sample A, except that magnetic gap layers 4 as thick as 5 μm were not formed on upper and lower layers (S3, S9) but only on intermediate layers (S4-S8).

(3) Production of Sample C (Comparative Example)

A single magnetic gap layer having the same thickness as the total gap length (15 μm) of the laminate device 10 (Sample A) was formed on a layer S5 to produce a laminate device (sample C).

(4) Evaluation

Figure 39:
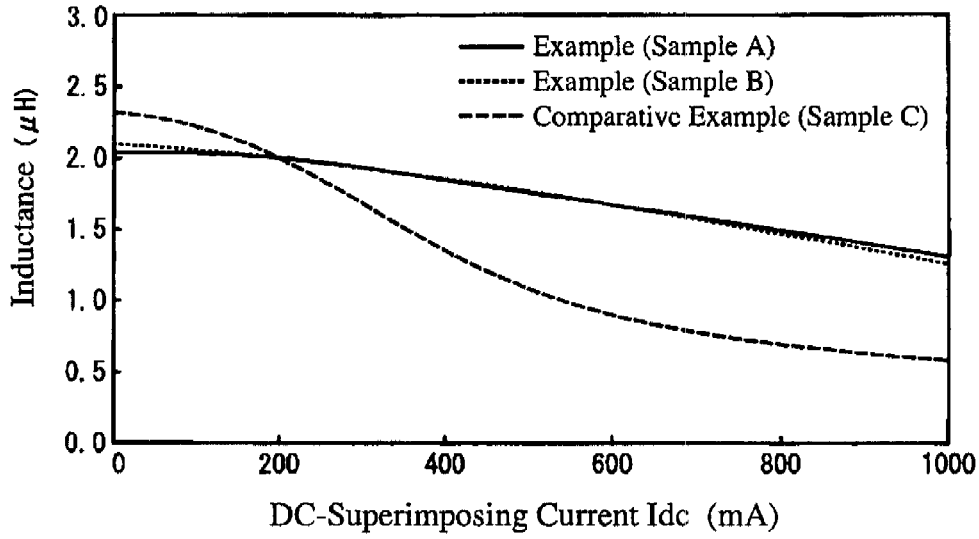
FIG. 39 is a graph showing the DC-superimposed characteristics of the first laminate device of the present invention.

With DC current of 0-1000 mA supplied to Samples A to C, their inductance (f=300 kHz, Im=200 μA) was measured by an LCR meter (4285A available from HP) to evaluate their DC-superimposed characteristics. The results are shown in FIG. 39. Inductance with no current load was largest in Comparative Example (sample C), and decrease in inductance when DC current was superimposed was smallest in Examples (Samples A and B). This indicates that the laminate devices of the present invention had drastically improved DC-superimposed characteristics.

Example 2

(1) Production of First Laminate Device Shown in FIGS. 7 and 8 (Sample 4 of Example)

A laminate device (laminated inductor, Sample 4) of 3.2 mm×1.6 mm and 1.0 mm in thickness having 7-μm-thick magnetic gap layers formed on all of 16 coil-pattern-carrying layers was produced in the same manner as in Example 1, except for using calcined Li—Mn—Zn ferrite powder (Curie temperature Tc: 250° C., and initial permeability at a frequency of 100 kHz: 300) comprising 3.8% by mass of $Li_2CO_3$, 7.8% by mass of $Mn_3O_4$, 17.6% by mass of ZnO, 69.8% by mass of $Fe_2O_3$, and 1.0% by mass of $Bi_2O_3$, in place of the calcined Ni—Cu—Zn ferrite powder. To be free from a step, each coil-pattern-carrying layer was printed with a Ni—Zn ferrite paste in a region in which the zirconia paste and the Ag paste were not printed. After sintering, the magnetic substrate layer had a thickness of 40 μm, the coil pattern had a thickness of 20 μm and a width of 300 μm, and a region inside the coil pattern was 2.2 mm×0.6 mm.

(2) Production of Samples 1-3 (Comparative Examples)

Obtained as Comparative Examples were a laminate device (Sample 1) produced in the same manner as in Sample 4 except for forming no magnetic gap layer, a laminate device (Sample 2) produced in the same manner as in Sample 4 except for forming only one magnetic gap layer on an intermediate layer, and a laminate device (Sample 3) produced in the same manner as in Sample 4 except for discontinuously forming three magnetic gap layers via magnetic layers free from magnetic gap layers.

Figure 40:
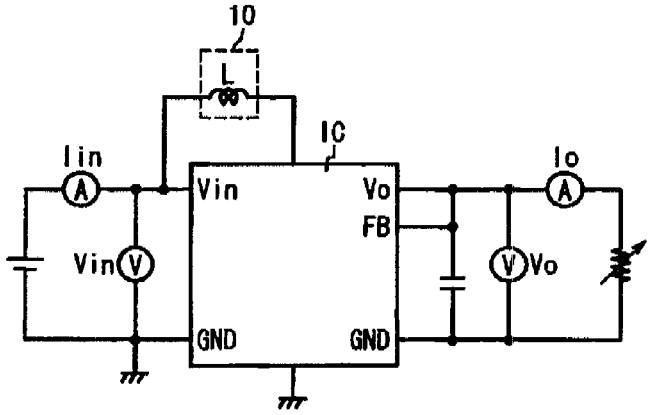
FIG. 40 is a view showing a circuit for measuring DC-DC conversion efficiency.
Figure 41:
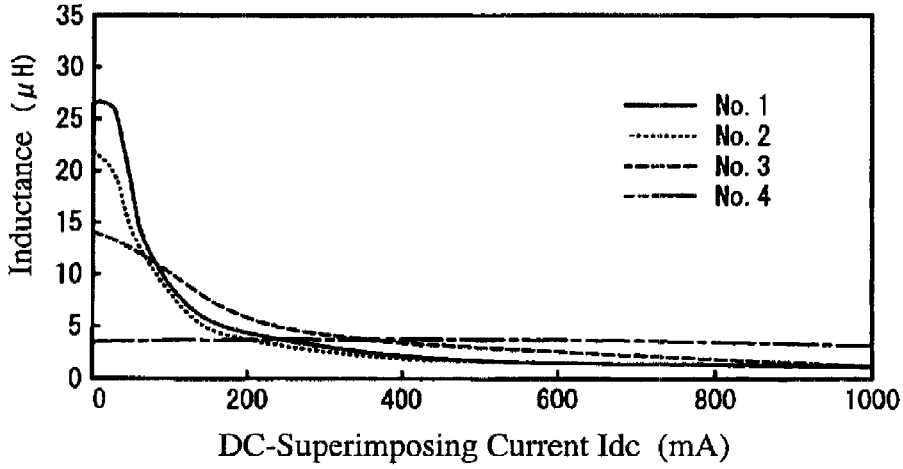
FIG. 41 is a graph showing the DC-superimposed characteristics of another example of the first laminate devices of the present invention.

The laminate devices (laminated inductors) of Samples 1-4 were measured with respect to DC-superimposed characteristics and DC-DC conversion efficiency. The DC-DC conversion efficiency was measured on each laminate device assembled in a measuring circuit shown in FIG. 40 (step-up DC-DC converter operable in a discontinuous current mode at a switching frequency fs of 1.1 MHz, input voltage Vin of 3.6 V, output voltage Vout of 13.3 V, and output current Io of 20 mA). The results are shown in Table 1 together with the structures of the laminate devices. The DC-superimposed characteristics of the laminate devices are shown in FIG. 41.

Decrease in inductance when DC current was superimposed was smaller in the laminate device of the present invention (Sample 4) having magnetic gap layers in all coil-pattern-carrying layers than in the conventional laminate device (Sample 1) free from magnetic gap layers, and the conventional laminate devices (Samples 2 and 3) having magnetic gap layers only in limited coil-pattern-carrying layers. Specifically, current when the inductance was reduced to 80% of that with no current load (3.9 μH) was 900 mA in the laminate device of the present invention (Sample 4), drastically improved as compared with Comparative Examples (Samples 1-3).

The laminated inductor of this Example (Sample 4) exhibited about 3% higher DC-DC conversion efficiency than those of Comparative Examples (Samples 1-3). It is considered that because the laminated inductor of this Example suffered less magnetic saturation in magnetic material portions between adjacent coil patterns (smaller magnetic loss), it exhibited improved DC-DC conversion efficiency.

Example 3

Production of Fourth Laminate Device Shown in FIGS. 13 and 14 (Sample 5)

Figure 42:
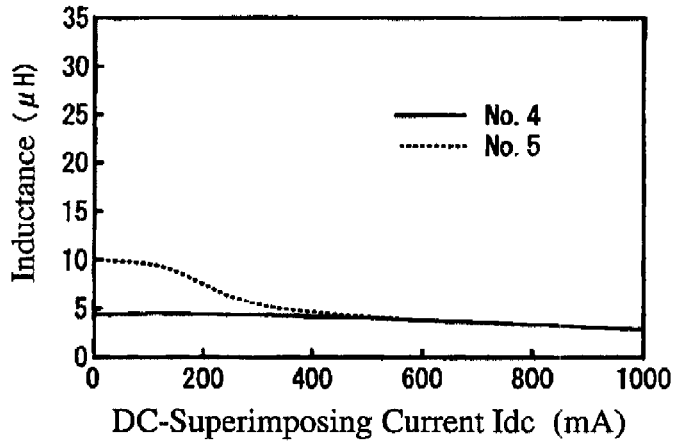
FIG. 42 is a graph showing the DC-superimposed characteristics of the second laminate device of the present invention.

A laminated inductor (Sample 5) was produced in the same manner as in Sample 4, except that a Li—Mn—Zn ferrite layer was formed in a rectangular opening 14 of 0.3 mm×0.3 mm provided in a region including the center axis of a coil in the magnetic gap layer. The laminated inductor of Sample 5 was measured with respect to DC-superimposed characteristics and DC-DC conversion efficiency. The results are shown in Table 2 and FIG. 42.

TABLE 1

| Sample | Number of Turns of Coil Pattern on Each Layer | Number of Coil-Pattern-Carrying Layers | Number of Magnetic Gap Layers | Thickness (μm) of Magnetic Gap Layer | Total Gap Length (μm) |
|---|---|---|---|---|---|
| *1 | 1 | 16 | 0 | 0 | 0 |
| *2 | 1 | 16 | 1 | 7 | 7 |
| *3 | 1 | 16 | 3 | 7 | 21 |
| 4 | 1 | 16 | 16 | 7 | 112 |

| Sample | Inductance (μH) With No Current Load | 80%-Inductance Current(1) (mA) | DC-DC Conversion Efficiency (%) |
|---|---|---|---|
| *1 | 25.6 | 40 | 74.5 |
| *2 | 21.2 | 40 | 74.5 |
| *3 | 14.2 | 80 | 74.3 |
| 4 | 3.9 | 900 | 77.5 |

Note:
*Comparative Example.
(1)Current when the inductance was reduced to 80% of that with no current load.

TABLE 2

| Sample | Number of Turns of Coil Pattern on Each Layer | Number of Coil-Pattern-Carrying Layers | Number of Magnetic Gap Layers | Thickness (μm) of Magnetic Gap Layer | Total Gap Length (μm) |
|---|---|---|---|---|---|
| 4 | 1 | 16 | 16 | 7 | 112 |
| 5 | 1 | 16 | 16 | 7 | 112 |

| Sample | Ferrite-Filled Layer in Magnetic Gap Layer | Inductance (μH) With No Current Load | DC-DC Conversion Efficiency (%) |
|---|---|---|---|
| 4 | No | 3.9 | 77.5 |
| 5 | Formed in all layers | 10.2 | 78.6 |

The laminated inductor of this Example (Sample 5) exhibited larger inductance than the second laminate device (Sample 4) at low DC current. Their inductance was substantially on the same level at high DC current. The DC-DC conversion efficiency of this Example was about 1% improved.

Example 4

(1) Production of Laminated Inductor Shown in FIGS. 20 and 21 (Sample 9)

A laminate device (Sample 9) was produced in the same manner as in Sample 4, except that the number of coil-pattern-carrying layers was 8, that a coil pattern on each layer had 2 turns, and that 5-μm-thick magnetic gap layers were formed on all layers. After sintering, each ferrite layer had a thickness of 40 μm, each coil pattern had a thickness of 20 μm, a width of 150 μm, and an interval of 50 μm, and a region inside the coil pattern was 1.9 mm×0.3 mm.

(2) Production of Samples 6-8 (Comparative Examples)

A laminated inductor (Sample 6) was produced in the same manner as in Sample 9 except for forming no magnetic gap layer. A laminated inductor (Sample 7) was produced in the same manner as in Sample 9 except for forming only one magnetic gap layer on an intermediate layer. A laminated inductor (Sample 8) was produced in the same manner as in Sample 9 except for discontinuously forming three magnetic gap layers via magnetic layers free from magnetic gap layers.

Figure 43:
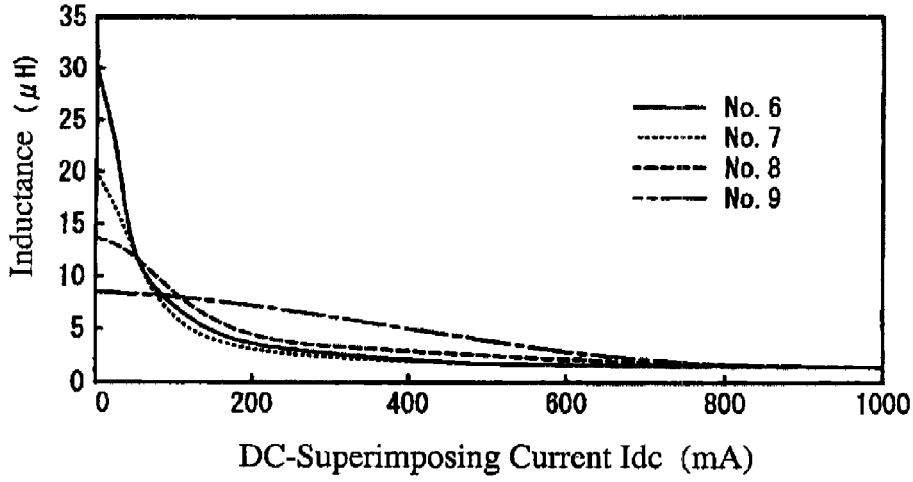
FIG. 43 is a graph showing the DC-superimposed characteristics of the third laminate device of the present invention.

The laminated inductors of Samples 6-9 were measured with respect to DC-superimposed characteristics and DC-DC conversion efficiency. The results are shown in Table 3 and FIG. 43.

TABLE 3

| Sample | Number of Turns of Coil Pattern on Each Layer | Number of Coil-Pattern-Carrying Layers | Number of Magnetic Gap Layers | Thickness (μm) of Magnetic Gap Layer | Total Gap Length (μm) |
|---|---|---|---|---|---|
| 4 | 1 | 16 | 16 | 7 | 112 |
| *6 | 2 | 8 | 0 | 0 | 0 |
| *7 | 2 | 8 | 1 | 5 | 5 |
| *8 | 2 | 8 | 3 | 5 | 15 |
| 9 | 2 | 8 | 8 | 5 | 40 |

| Sample | Inductance (μH) With No Current Load | 80%-Inductance Current(1) (mA) | DC-DC Conversion Efficiency (%) |
|---|---|---|---|
| 4 | 3.9 | 900 | 77.5 |
| *6 | 30.7 | 30 | 68.3 |
| *7 | 20 | 40 | 70.2 |
| *8 | 14.6 | 60 | 71 |
| 9 | 8.8 | 280 | 77 |

Note:

*Comparative Example (1)Current when the inductance was reduced to 80% of that with no current load.

The laminate device of this Example (Sample 9) exhibited increased inductance as compared with the laminate device of Example 2 (Sample 4) having one turn of a coil pattern on each layer. The laminate device of the present invention (Sample 9) having magnetic gap layers in all magnetic layers provided with coil patterns suffered less decrease in inductance when DC current was superimposed, as compared with the conventional laminated inductor (Sample 6) having no magnetic gap layer, and the conventional laminated inductors (Samples 7 and 8) having magnetic gap layers only in limited magnetic layers. Specifically, the laminate device of the present invention (Sample 9) had L of 8.8 μH with no current load, and current drastically improved to 280 mA when the inductance was reduced to 80% of that with no current load. The laminate device of this Example (Sample 9) also exhibited about 9% higher DC-DC conversion efficiency than Comparative Examples (Samples 6-8).

Example 5

Production of Sixth Laminate Device Shown in FIGS. 23 and 24

Figure 44:
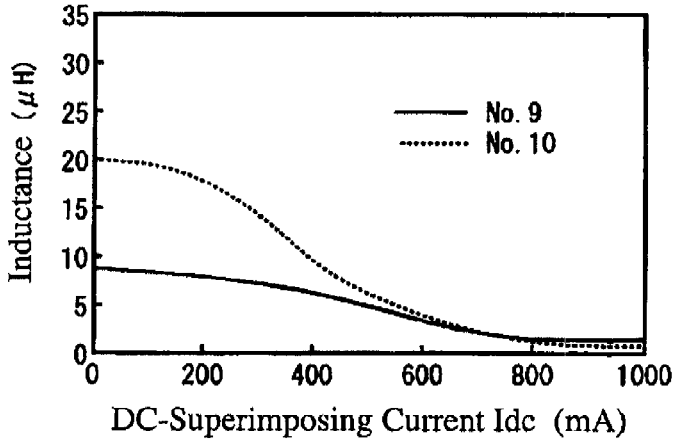
FIG. 44 is a graph showing the DC-superimposed characteristics of the fourth laminate device of the present invention.

A laminate device (Sample 10) was produced in the same manner as in Sample 9, except that a Li—Mn—Zn ferrite layer was formed in a rectangular opening 14 of 0.3 mm×0.3 mm formed in a region including the center axis of a coil in the magnetic gap layer 4. After sintering, each ferrite layer had a thickness of 40 μm, and each coil pattern had a thickness of 20 μm and 2 turns. The laminate device of Sample 10 was measured with respect to DC-superimposed characteristics and DC-DC conversion efficiency. The results are shown in Table 4 and FIG. 44.

TABLE 4

| Sample | Number of Turns of Coil Pattern on Each Layer | Number of Coil-Pattern-Carrying Layers | Number of Magnetic Gap Layers | Thickness (μm) of Magnetic Gap Layer | Total Gap Length (μm) |
|---|---|---|---|---|---|
| 9 | 2 | 8 | 8 | 5 | 40 |
| 10 | 2 | 8 | 8 | 5 | 40 |

| Sample | Ferrite-Filled Layer in Magnetic Gap Layer | Inductance (μH) With No Current Load | DC-DC Conversion Efficiency (%) |
|---|---|---|---|
| 9 | No | 8.8 | 77 |
| 10 | Formed in all layers | 20.3 | 79.2 |

The laminate device of this Example (Sample 10) exhibited larger inductance at low DC current as compared with the laminate device of Example 4 (Sample 9), though substantially on the same level at high DC current. It also exhibited about 2% higher DC-DC conversion efficiency.

Example 6

Production of Fifth Laminate Devices Shown in FIGS. 20 and 21 (Samples 11 and 12)

Figure 45:
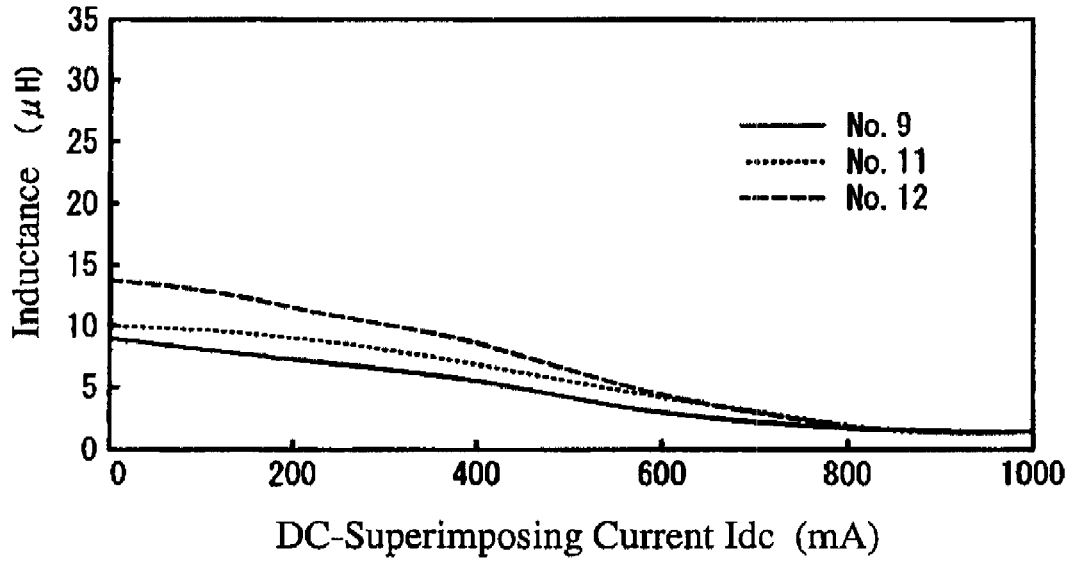
FIG. 45 is a graph showing the DC-superimposed characteristics of another example of the third laminate devices of the present invention.

A laminate device (Sample 11) of 3.2 mm×1.6 mm and 1.0 mm in thickness was produced in the same manner as in Sample 4, except that the number of coil-pattern-carrying layers was 10, and that 5-μm-thick magnetic gap layers were formed on all layers. A laminate device (Sample 12) was produced in the same manner as in Sample 11, except that the number of coil-pattern-carrying layers was 12. In both Samples 11 and 12 after sintering, the magnetic substrate layer had a thickness of 40 μm, and the coil pattern had a thickness of 20 μm and 2 turns. The laminate devices were measured with respect to DC-superimposed characteristics and DC-DC conversion efficiency. The results are shown in Table 5 and FIG. 45

TABLE 5

| Sample | Number of Turns of Coil Pattern on Each Layer | Number of Coil-Pattern-Carrying Layers | Number of Magnetic Gap Layers | Thickness (μm) of Magnetic Gap Layer | Total Gap Length (μm) |
|---|---|---|---|---|---|
| 9 | 2 | 8 | 8 | 5 | 40 |
| 11 | 2 | 10 | 10 | 5 | 50 |
| 12 | 2 | 12 | 12 | 5 | 60 |

| Sample | Inductance (μH) With No Current Load | 80%-Inductance Current[(1)] (mA) | DC-DC Conversion Efficiency (%) |
|---|---|---|---|
| 9 | 8.8 | 280 | 77 |
| 11 | 10.1 | 340 | 78.3 |
| 12 | 13.8 | 280 | 79.1 |

Note:
[(1)]Current when the inductance was reduced to 80% of that with no current load.

As the number of coil-pattern-carrying layers increased, the inductance with no current load and the DC-DC conversion efficiency increased. Also, both laminate devices exhibited large current when the inductance was reduced to 80% of that with no current load.

Example 7

Production of Fifth Laminate Devices Shown in FIGS. 20 and 21 (Samples 13-15)

Figure 46:
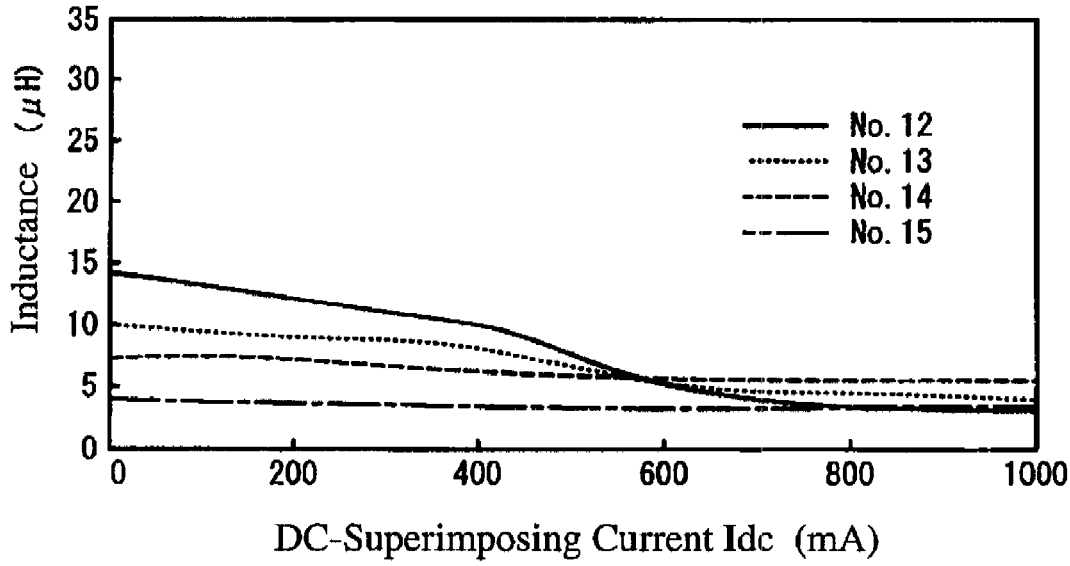
FIG. 46 is a graph showing the DC-superimposed characteristics of a further example of the third laminate devices of the present invention.

A laminated inductor (Sample 13) of 3.2 mm×1.6 mm and 1.0 mm in thickness was produced in the same manner as in Sample 4, except that the number of coil-pattern-carrying layers was 12, and that 10-μm-thick magnetic gap layers were formed on all layers. A laminated inductor (Sample 14) was produced in the same manner as in Sample 13, except that 15-μm-thick magnetic gap layers were formed on all layers. A laminated inductor (Sample 15) was produced in the same manner as in Sample 13, except that 20-μm-thick magnetic gap layers were formed on all layers. In any of the laminated inductors of Samples 13-15 after sintering, the magnetic substrate layer had a thickness of 40 μm, and the coil pattern had a thickness of 20 μm and 2 turns. The laminate devices of Samples 13-15 were measured with respect to DC-superimposed characteristics and DC-DC conversion efficiency. The results are shown in Table 6 and FIG. 46.

TABLE 6

| Sample | Number of Turns of Coil Pattern on Each Layer | Number of Coil-Pattern-Carrying Layers | Number of Magnetic Gap Layers | Thickness (μm) of Magnetic Gap Layer | Total Gap Length (μm) |
|---|---|---|---|---|---|
| 12 | 2 | 12 | 12 | 5 | 60 |
| 13 | 2 | 12 | 12 | 10 | 120 |
| 14 | 2 | 12 | 12 | 15 | 180 |
| 15 | 2 | 12 | 12 | 20 | 240 |

| Sample | Inductance (μH) With No Current Load | 80%-Inductance Current(1) (mA) | DC-DC Conversion Efficiency (%) |
|---|---|---|---|
| 12 | 13.8 | 280 | 79.1 |
| 13 | 10 | 340 | 79.8 |
| 14 | 7.3 | 560 | 80.3 |
| 15 | 4.2 | 510 | 76.1 |

Note:
(1)Current when the inductance was reduced to 80% of that with no current load.

As the magnetic gap layers became thicker, the inductance with no current load decreased, but the inductance when the current was reduced to 80% of that with no current load was drastically improved. The laminate device (Sample 15), in which the magnetic gap layer was as thick as 20 μm, the same as the coil pattern, exhibited lower conversion efficiency than those of the other laminate devices. This appears to be due to the fact that the magnetic gap layer had large magnetic resistance, thereby increasing the amount of a magnetic flux leaking to the coil pattern, which in turn increased eddy current loss and thus lowered conversion efficiency.

Although the laminate device of the present invention has been explained above, the number of coil-pattern-carrying layers, the number of turns of a coil pattern on each layer, the thickness and material of the coil pattern and the magnetic gap layer, etc. are not restricted to those described in Examples. The proper adjustment of these parameters can provide laminate devices having magnetic properties desired for electronic equipments used.

EFFECT OF THE INVENTION

The laminate devices of the present invention having the above monolithic structure have excellent DC-superimposed characteristics, and DC-DC converters comprising them exhibit high conversion efficiency and are usable at large current. Accordingly, DC-DC converters comprising the laminate devices of the present invention are useful for various portable electronic equipments using batteries, such as cell phones, portable information terminals PDA, note-type personal computers, portable audio/video players, digital cameras, digital video cameras, etc.

What is claimed is:

1. A laminate device comprising magnetic layers and coil patterns alternately laminated, said coil patterns being connected in a lamination direction to form a coil, wherein magnetic gap layers are formed in contact with the edge of at least two coil patterns adjacent in a lamination direction via said magnetic layer, wherein each magnetic gap layer is disposed in at least one of a region inside each coil pattern and a region outside each coil pattern, and wherein the thicknesses of said magnetic gap layers are equal to or less than that of said coil pattern.

2. The laminate device according to claim 1, wherein said magnetic gap layers are formed on all intermediate layers except uppermost and/or lowermost layers of said magnetic layers in a coil forming part.

3. The laminate device according to claim 1, wherein said magnetic gap layers are made of a non-magnetic material or a low-permeability material having a specific permeability of 1-5.

4. The laminate device according to claim 1, wherein said magnetic gap layers are formed on all of said magnetic layers in a coil forming part.

5. A module comprising a laminate device comprising magnetic layers and coil patterns alternately laminated, said coil patterns being connected in a lamination direction to form a coil, wherein magnetic gap layers are formed in contact with the edge of at least two coil patterns adjacent in a lamination direction via said magnetic layer, wherein each magnetic gap layer is disposed in at least one of a region inside each coil pattern and a region outside each coil pattern, wherein said laminate device is mounted on a dielectric substrate containing capacitors or a resin board together with a semiconductor part including a switching device, and wherein the thicknesses of said magnetic gap layers are equal to or less than that of said coil pattern.

6. A module comprising a laminate device comprising magnetic layers and coil patterns alternately laminated, said coil patterns being connected in a lamination direction to form a coil, wherein magnetic gap layers are formed in contact with the edge of at least two coil patterns adjacent in a lamination direction via said magnetic layer, wherein each magnetic gap layer is disposed in at least one of a region inside each coil pattern and a region outside each coil pattern, wherein a semiconductor part including a switching device is mounted on said laminate device, and wherein the thicknesses of said magnetic gap layers are equal to or less than that of said coil pattern.

7. A laminate device comprising magnetic layers and coil patterns alternately laminated, said coil patterns being connected in a lamination direction to form a coil, wherein magnetic gap layers are formed on at least two magnetic layers adjacent in a lamination direction, wherein each magnetic gap layer is disposed in at least one of a region inside each coil pattern and a region outside each coil pattern, wherein each magnetic gap layer being in contact with the edge of each coil pattern, and wherein the thicknesses of said magnetic gap layers are equal to or less than that of said coil pattern.

8. The laminate device according to claim 7, wherein said magnetic gap layers are formed on all intermediate layers except uppermost and/or lowermost layers of said magnetic layers in a coil forming part.

9. The laminate device according to claim 7, wherein said magnetic gap layers are formed on all of said magnetic layers in a coil forming part.

* * * * *